US005998117A

United States Patent [19]

Sugino et al.

[11] Patent Number: 5,998,117

[45] **Date of Patent: *Dec. 7, 1999**

[54] SILVER HALIDE PHOTOGRAPHIC LIGHT-SENSITIVE MATERIAL

[75] Inventors: Motoaki Sugino; Nobuaki Kagawa; Shigeto Hirabayashi; Atsushi Tomotake; Satoshi Nakagawa, all of Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,017

[22] Filed: Mar. 6, 1997

[30] Foreign Application Priority Data

Mar. 11, 1996 [JP] Japan ..... 8-052722
May 22, 1996 [JP] Japan ..... 8-127105

[51] Int. Cl.[6] ..... G03C 1/34

[52] U.S. Cl. ..... 430/512; 430/510; 430/513; 430/517; 430/519; 430/522

[58] Field of Search ..... 430/510, 512, 430/513, 517, 519, 522, 570

[56] References Cited

U.S. PATENT DOCUMENTS

| | | | |
|---|---|---|---|
| 4,440,852 | 4/1984 | Onishi et al. | 430/522 |
| 4,764,455 | 8/1988 | Arakawa et al. | 430/517 |
| 4,923,789 | 5/1990 | Yagihara et al. | 430/517 |
| 5,063,146 | 11/1991 | Inagaki et al. | 430/522 |
| 5,075,205 | 12/1991 | Inagaki et al. | 430/522 |
| 5,079,134 | 1/1992 | Toya | 430/522 |
| 5,147,769 | 9/1992 | Toya et al. | 430/502 |
| 5,187,051 | 2/1993 | Ishikawa | 430/523 |
| 5,213,957 | 5/1993 | Adachi | 430/522 |
| 5,238,798 | 8/1993 | Usami | 430/522 |
| 5,346,810 | 9/1994 | Ohno | 430/522 |

FOREIGN PATENT DOCUMENTS

| | | |
|---|---|---|
| 0215124 | 3/1987 | European Pat. Off. . |
| 0401709 | 12/1990 | European Pat. Off. . |
| 3208046 | 11/1991 | Japan . |

OTHER PUBLICATIONS

European Search Report EP 97 30 1566.

*Primary Examiner*—Hoa Van Le
*Attorney, Agent, or Firm*—Jordan B. Bierman; Bierman, Muserlian and Lucas

[57] ABSTRACT

A silver halide photographic light-sensitive material is disclosed. The light-sensitive material comprises a support and one or more photographic constituent layers and at least one of said layers contains a dye capable of being decolored by reacting with a color developing agent.

6 Claims, No Drawings

SILVER HALIDE PHOTOGRAPHIC LIGHT-SENSITIVE MATERIAL

FIELD OF THE INVENTION

The present invention relates to a silver halide photographic light-sensitive material, hereinafter simply referred to a photographic light-sensitive material, having a dyed hydrophilic colloid layer, particularly relates to a silver halide photographic light-sensitive material containing a novel diffusion-proof dye which does not cause lowering in the sensitivity, and the photographic material is improved in the decoloring property and lowered in the fog.

BACKGROUND OF THE INVENTION

Recently, a demand to improvement of the properties of a silver halide photographic light-sensitive material has been made serious and a higher level of the image quality such as a sharpness and a color reproduce ability is required.

It is further required to shorten the processing time for realizing an extreme rapid processing for rivaling to the instantaneousness of an electrophotographic material. In the field of the photography, it has been tried to reduce the layer thickness, and to optimize the kind of silver halide and additives in the light-sensitive material, for realizing a high image quality and an extreme rapid processing.

Generally, it has been well known to add a dye into a silver halide photographic light-sensitive material for the purpose of improving the image quality or controlling the sensitivity of a light-sensitive emulsion. For instant, the dye is used for anti-halation, anti-irradiation and a light-absorbing filter. Recently, the use of the dye is extended, for example, the dye is used for replacing yellow colloid silver in a color photographic material (hereinafter referred as YC dye), for dying the crossover cutting layer of a radiographic light-sensitive material and for dying the non-light-sensitive layer of a light-sensitive material for photomechanical use.

The dye used for such the purposes has to satisfy various requirements that the dye is completely decolored during the processing, easily dissolved out from the light-sensitive material during the processing thereof, does not cause any stain by color remaining, does not give any bad influence on the properties light-sensitive emulsion such as fogging and desensitization, stably xists in the light-sensitive material or emulsion coating liquid and does not cause decoloration during the producing process or the storage of the light-sensitive material, as well as the dye has a good spectral absorption property according to the purpose of the use thereof.

Many kinds of dye have been proposed to satisfy the above-mentioned requirements. For example, azo dyes, oxonol dyes described in British Patent No. 506,385 and Japanese Patent No. 39-22069, merocyanine dyes described in U.S. Pat. No. 2,493,747 and styryl dyes described in U.S. Pat. No. 1,845,404 have been proposed. Generally these dyes are not reactable with a color developing agent and are dissolved out into an alkaline solution or a solution contianing a sulfite ion.

In a usual method, these dyes are dissolved in water or a water-miscible organic solvent and added into a photographic constitution layer. When the dye is water-soluble, a problem that the dye is not fixed in the layer to be colored and diffused to another layer. Accordingly, it is necessary to supplement the amount of the dye corresponding to that of the dye to be diffused out to another layer for attaining the purpose of the addition of the dye. As a result of that, not preferable result such as lowering in the sensitivity, changing in the gradation and unusual fogging are occurred. Particularly, fogging and desensitization are considerably occurred when the light-sensitive material was stored for a prolonged period. A satisfactory light absorption effect cannot be attained when the amount of the dye is decreased to avoid such the not preferred influences. As a countermeasure to such the problem, dyes are known which have an inhibited diffusibility so as to dye a specified layer. As examples of diffusion-proof dye, oil-soluble dyes are described in U.S. Pat. Nos. 2,538,008, 2,538,009, 4,420,555 and 4,940,654, and Japanese Patent Publication Open for Public Inspection (JP O.P.I.) Nos. 61-204630, 61-205934, 62-32460, 62-56958, 62-92949, 62-222248, 63-40143, 63-184749, 63-316852, 1-179042, 3-75632, 3-109535, 3-144438, 3-179441, 4-362634, 5-53241, 5-86056, 5-209133, 5-289239 and 5-296848.

Further, a method using solid particles of a water-insoluble dye is described in WO 88/4,794, U.S. Pat. Nos. 4,904,565 and 4,923,788, and JP O.P.I. Nos. 63-197943, 64-40827, 1-155341, 1-172828, 2-1839, 2-110453, 3-23341, 3-206443, 3-216644, 3-216645, 3-216646, 3-217838, 3-231241, 4-37740, 4-37841, 4-44033, 4-116548, 4-296848, 5-197079 and 6-110155.

However, these compounds are insufficient in the decoloring ability and have a drawback that a color stain is remained. The dyes are also insufficient in the diffusion-proof ability thereof and give bad influences on the sensitivity and fogging of the light-sensitive material.

Water-insoluble dyes having a 3,5-pyrazolidinedione nucleus are known which are described in JP O.P.I. Nos. 3-167546, 3-208044, 3-208045 and 3-208046. Although these dyes have both of the diffusion-proof ability and decoloring ability in some degree, levels of these properties of the dyes are still insufficient. The dye has drawback that the required optical density for the purpose of the use is difficulty obtained and the surface of the light-sensitive material is roughed by precipitation of the dye since the solubility of the dye in an organic solvent is too small. Further the stability of the dye in light-sensitive material during the storage is insufficient and further improvement is required.

SUMMARY OF THE INVENTION

The object of the invention is to provide a silver halide photographic light-sensitive material containing a novel diffusion-proof dye by which a specified layer can be optionally dyed and the decoloring ability is improved so as to adapt to a present rapid processing and the above-mentioned requirements to dye are satisfied.

The above object of the invention has been attained by a silver halide photographic light-sensitive material comprising a support having thereon one or more photographic constituent layers and at least one of said layers contains a dye capable of being decolored by reacting with a color developing agent.

In the preferable embodiment of the invention, the above-mentioned dye capable of being decolored by reaction with a color developing agent is a compound represented by the following Formula 1;

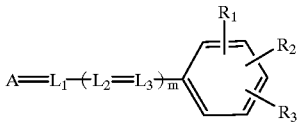

wherein A is an acidic nucleus, $R_1$, $R_2$ and $R_3$ are each independently an hydrogen atom or a substituent, two of $R_1$, $R_2$ and $R_3$ may form a ring, $L_1$, $L_2$ and $L_3$ are each a methine group, m represents 0, 1 or 2, provided that the compound has in the molecule thereof at least one group selected from the group consisting of a carbamoyl group, a sulfamoyl group, a sulfonamido group, $—SO_2NHCOR_4$, $—CONHSO_2R_4$ and $—CONHCOR_4$, in which $R_4$ is an alkyl group, a cycloalkyl group, an aryl group a heterocyclic group, an alkoxy group and an amino group.

Among the compounds represented by Formula 1, a compound represented by the following Formula 2 is preferred;

Formula (2)

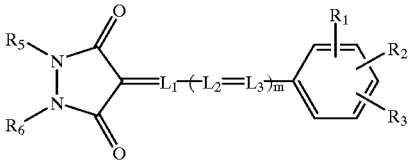

wherein $R_1$, $R_2$, $R_3$, $L_1$, $L_2$, $L_3$ and m are each the same as $R_1$, $R_2$, $R_3$, $L_1$, $L_2$, $L_3$ and m in Formula 1, respectively, $R_5$ and $R_6$ are each an alkyl group, a cycloalkyl group, an aryl group or a heterocyclic group, provided that the compound has in the molecule thereof selected from at least one group selected from group consisting of a carbamoyl group, sulfamoyl group, a sulfonamido group, $—SO_2NHCOR_4$ , $—CONHSO_2R_4$ and $—CONHCOR_4$, in which $R_4$ is the same as $R_4$ in Formula 1.

In the light-sensitive material, the dye is preferably contained in the photographic constituent layer in a form of a high-boiling solvent solution.

In the invention, "the light-sensitive material contains the dye in a form of solution with a high-boiling solvent" means that the dye is dissolved in a high-boiling solvent and added in the constituent layer of the light-sensitive material. In the invention, the "oil-soluble dye" means a dye capable of dissolving in an amount of 10% by weight or more at 25° C. in a high-boiling solvent having a boiling point of not lower than 160° C.

DETAILED DESCRIPTION OF THE INVENTION

In Formula 2, the alkyl group represented by $R_5$ or $R_6$ includes, for example, a methyl group, ethyl group, propyl group, i-propyl group, butyl group, sec-butyl group, tert-butyl group, pentyl group, hexyl group, octyl group, decyl group and hexadecyl group. The alkyl group includes ones having a substituent. As the substituent, a cycloalkyl group, an aryl group, a heterocyclic group, a halogen atom, a hydroxyl group, an alkoxy group, an aryloxy group, a mercapto group, an alkoxycarbonyl group, an aryloxycarbonyl group, an acyl group, a sulfonyl group, a carbamoyl group, a sulfamoyl group, an amino group, a cyano group and a nitro group are cited.

The cycloalkyl group represented by $R_5$ or $R_6$ includes, for example, a cyclopropyl group, cyclobutyl group, cyclopentyl group and cyclohexyl group. The cycloalkyl group includes ones having a substituent. The substituent includes the above-mentioned alkyl groups and the groups described as the substituent of the alkyl group.

The aryl group represented by $R_5$ or $R_6$ includes, for example, a phenyl group and 1-naphtyl group are cited. The aryl group includes ones having a substituent. The substituent includes the above-mentioned alkyl groups and the groups described as the substituent of the alkyl group.

The halogen atom includes, for example, fluorine atom, chlorine atom, bromine atom and iodine atom.

The alkoxy group includes ones having the above mentioned alkyl group or cycloalkyl group as the alkyl moiety thereof, for example, a methoxy group, ethoxy group, iso-propyloxy group, butoxy group, t-butoxy group, octyloxy group, cyclopentyloxy group, 2-methoxyethoxy group, 2-aminoethoxy group, 2-cyanoethoxy group, 2-hydroxyethoxy group, 2-methanesulfonyl-aminoethoxy group, 2-ethoxycarbonylethoxy group and benzyloxy group.

The aryloxy group includes, ones having the above-mentioned aryl group as the aryl moiety thereof, for example, a phenoxy group, 1-naphthoxy group, 2,5-di-t-amilphenoxy group and 4-dimethylaminophenoxy group.

The mercapto group includes, for example, a methylmercapto group, ethylmercapto group, propylmercapto group, iso-propylmercapto group, butylmercapto group, octylmercapto group, cyclohexyl-mercapto group, 2-aminoethylmercapto group, 2-ethoxyethyl-mercapto group, 2-hydroxyethylmercapto group and phenylmercapto group.

The alkoxycarbonyl group includes ones having the above-mentioned alkyl group or cycloalkyl group as the alkyl moiety thereof, for example, a methoxycarbonyl group, ethoxycarbonyl group, iso-propyloxycarbonyl group, tert-butoxycarbonyl group, octyloxycarbonyl group, tetradecyloxy-carbonyl group, cyclohexyloxycarbonyl group, benzyloxycarbonyl group, 2-methoxyethoxycarbonyl group, 2-fluoroethoxycarbonyl group, 2-cyanoethoxycarbonyl group, 2-hydroxyethoxycarbonyl group, 2-dimethylaminoethoxycarbonyl group, 2-methoxycarbonylethoxycarbonyl group and methanesulfonylaminoethoxycarbonyl group.

The aryloxycarbonyl group includes, ones having the above-mentioned aryl group as the aryl moiety thereof, for example, a phenoxycarbonyl group, 2-methylphenoxycarbonyl group, 3-nitrophenoxycarbonyl group, 4-methoxyphenoxycarbonyl group, 4-methanesulfonylaminophenoxycarbonyl group and 2-naphthoxycarbonyl group.

The acyl group includes, for example, an acetyl group, propionyl group, butylyl group, hexanoyl group, benzoyl group, 4-nitrobenzoyl group, 4-cyanobenzoyl group, 4-dimethylaminobenzoyl group, 4-ethanesulfonylaminobenzoyl group, 3-methylbenzoyl group and 2-ethoxycarbonylbenzoyl group.

The sulfonyl group includes, for example, a methylsulfonyl group, ethylsulfonyl group, propylsulfonyl group,, iso-propylsulfonyl group, t-butylsulfonyl group, octylsulfonyl group, cyclopentylsulfonyl group and phenylsulfonyl group.

The carbamoyl group and the sulfamoyl group includes, for example, a methylcarbamoyl group, phenylcarbamoyl group, methylsulfamoyl group and phenylsulfamoyl group, they may be substituted by the above-mentioned alkyl group, alkoxy group or aryloxy group.

The amino group may be substituted by the above-mentioned alkyl group, aryl group, acyl group, sulfonyl group, carbamoyl group or sulfamoyl group.

The heterocyclic group represented by $R_5$ and $R_6$ includes, for example, a pyridyl group, furyl group and pyrrolyl group, and the ring formed by $R_5$ and $R_6$ includes, for example, a pyrazole ring, pyrazolidine ring and indazole ring In Formulas 1 and 2, $R_1$, $R_2$ and $R_3$ are each independently a hydrogen atom or a substituent, and two of $R_1$, $R_2$ and $R_3$ may form a ring.

The substituent represented by $R_1$, $R_2$ and $R_3$ includes an alkyl group, a cycloalkyl group, an aryl group, a heterocyclic group, a halogen atom, a hydroxyl group, an alkoxy group, an aryloxy group, a mercapto group, a carboxyl group, an alkoxycarbonyl group, an aryloxycarbonyl group, an acyl group, a sulfonyl group, an amino group, a cyano group and nitro group. These groups represented by $R_1$, $R_2$ and $R_3$ are the same as those described with respect to $R_5$ and $R_6$. Examples of the ring formed by two of $R_1$, $R_2$ and $R_3$ include a benzene ring, cyclohexene ring and pyridine ring.

The methine group represented by $L_1$, $L_2$ and $L_3$ each may have a substituent. As the substituent, an alkyl group, a cycloalkyl group, an aryl group, a heterocyclic group, a halogen atom, an alkoxy group, a hydroxyl group, an alkoxycarbonyl group and a carbamoyl group are cited. Concrete examples of the substituent include those above-mentioned.

m represents 0, 1 or 2. When n is 2, two $L_2$'s may be the same or different from each other, for example, one of $L_2$'s has a substituent and another one has no substituent. Two $L_3$'s also may be the same or different The dyes represented by Formulas 1 or 2 each has at least one group selected from a carbamoyl group, sulfamoyl group, sulfonamido group, $—SO_2NHCOR_6$, $—CONHSO_2R_6$ and $—CONHCOR_6$ in which $R_6$ is an alkyl group, a cycloalkyl group, an aryl group, a heterocyclic group, an alkoxy group or an amino group.

In Formula 1, the acidic nucleus represented by A is preferably a methylene group being put between electron withdrawing groups or cyclic ketomethylene groups. Examples of the acidic nucleus are shown below. In the followings, the nuclei in the keto form or their analogues are only shown.

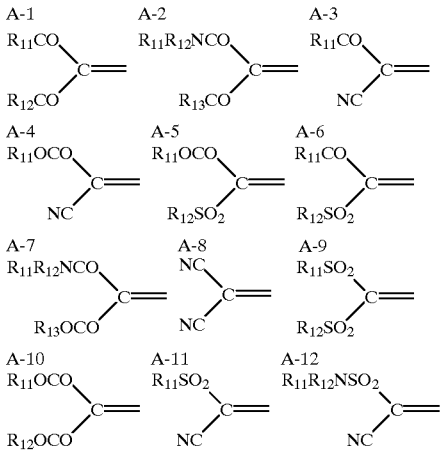

-continued

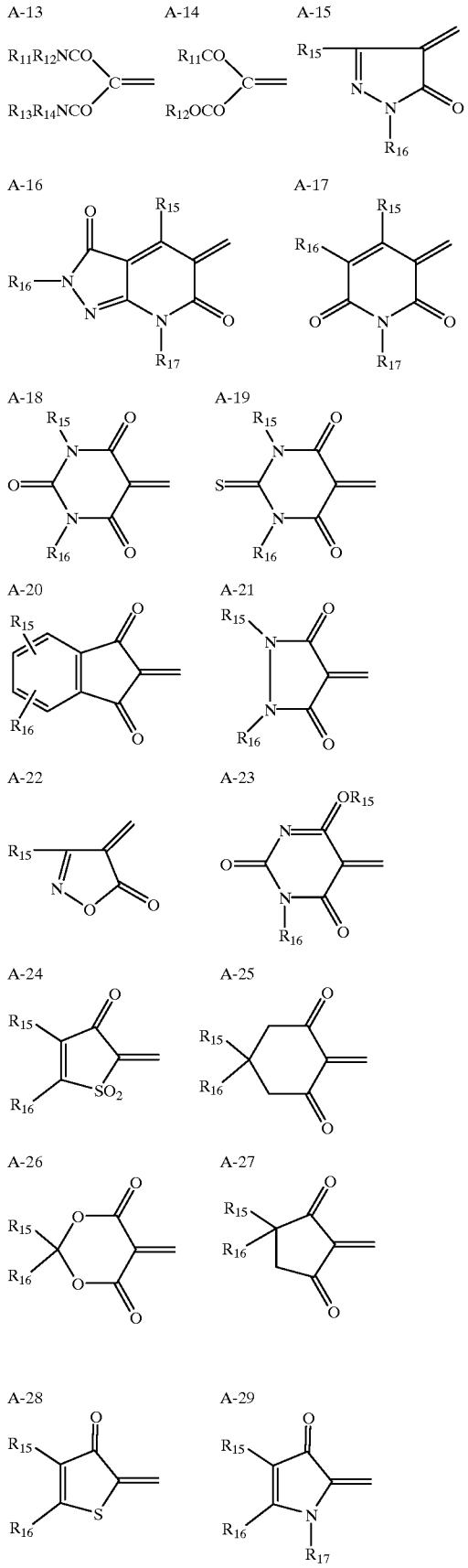

-continued

A-30

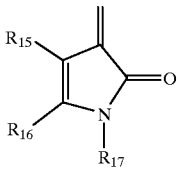

A-31

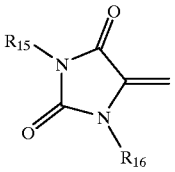

A-32

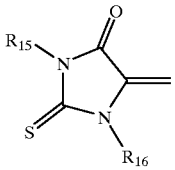

A-33

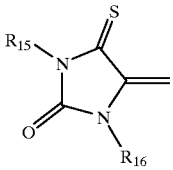

A-34

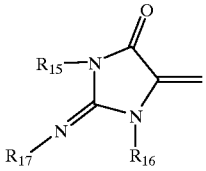

A-35

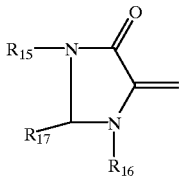

A-36

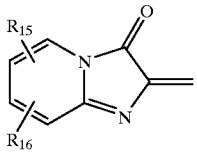

A-37

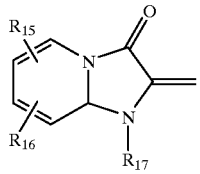

A-38

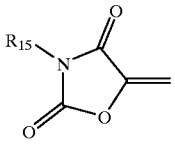

A-39

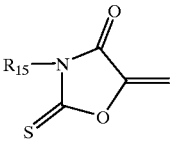

A-40

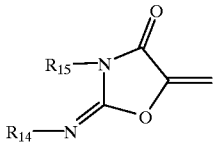

A-41

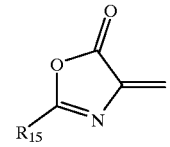

A-42

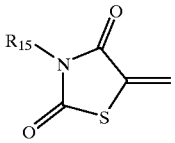

A-43

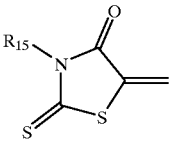

A-44

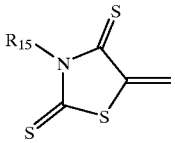

A-45

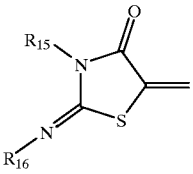

A-46

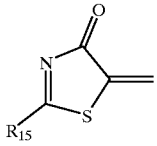

A-47

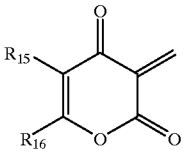

-continued

A-48

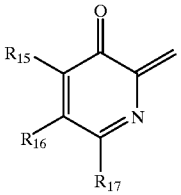

A-49

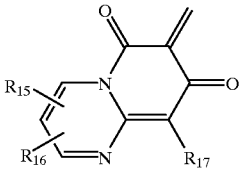

A-50

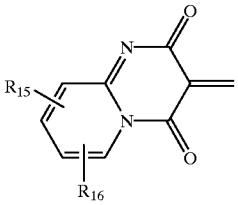

A-51

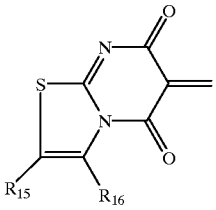

A-52

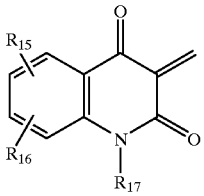

A-53

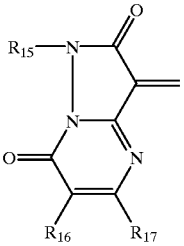

A-54

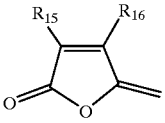

A-55

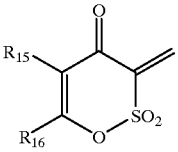

A-56

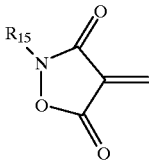

A-57

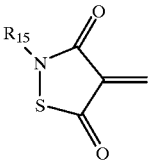

In the above formulas, $R_{11}$, $R_{12}$, $R_{13}$ and $R_{14}$ are each an alkyl group, a cycloalkyl group or an aryl group. These alkyl group, cycloalkyl group and aryl group may have a substituent the same as those of $R_5$ and $R_6$. $R_{15}$, $R_{16}$ and $R_{17}$ are the same as the group represented by $R_1$, $R_2$, and $R_3$.

It is usually considered that the decoloration of dye depends only on dissolving of the dye in an alkaline solution or a solution containing a sulfite ion by reaction of the dye with a sulfite ion. It has been found by the inventors that the dye capable of being decolored by reaction with a color developing agent and the decoloring property of the light-sensitive material can be improved by the use of such the dye.

In the invention, any dye capable of being decolored by reacting with a color developing agent are usable. Decoloration of the dye of the invention is considerably accelerated by reacting with the color developing agent even though the dye is dissolved out in an alkaline solution or a solution containing a sulfite like as an ordinary dye. In the invention, the "decoloration" includes either the case in which the dye is decolored itself or the case in which the dye is dissolved away from the light-sensitive material, as a result of that the color of the light-sensitive material before the processing is changed after the processing.

The degree of decoloration of a dye is determined by the following equation 1:

$$\text{Decoloring ratio } (\%)=(E_1-E_2)/E_1\times 100 \quad (1)$$

In the above equation, $E_1$ and $E_2$ are each an optical absorbency before and after immersion in a developer, respectively. In the invention, "the dye capable of being decolored by reacting with a color developing agent" is defined by the following method.

The dispersion was prepared by the following composition was prepared.

| | |
|---|---|
| Dye to be determined | 0.25 g |
| Tricresil phosphate | 0.42 g |
| Ethyl acetate | 1.2 ml |
| Surfactant (1) | 1.4 ml |
| 10% aqueous solution of gelatin | 12.3 g |

The above mixture is dispersed by ultrasonic mave. A coating liquid having the following composition is prepared.

| | |
|---|---|
| The above-mentioned dispersion | 11.1 g |
| Pure water | 17.0 g |
| 1% aqueous solution of Surfactant 2 | 1.4 ml |
| 1% aqueous solution of Hardener 1 | 15.4 ml |

Chemical formulas of Surfactants 1 and 2 and Hardener 1 are shown in the later-mentioned Example 1.

The coating solution is coated and dried on a cellulose triacetate support so that the coating amount of gelatin is 1.2 g/m$^2$.

One piece thus obtained sample is treated by the following Solution A for 3 minutes 15 seconds at 38° C. to determine decoloring ratio A' according to the above-mentioned equation 1. Another piece of the sample is treated in the same manner except that Solution A is replaced by Solution B containing no color developing agent to determine a decoloring ratio B'.

"The dye capable of being decolored by reacting with a color developing agent" in the invention is defined as one having a value of X of not more than 0.5. The value of X is calculated by the following equation 2.

$$X = (100 - B')/(100 - A') \quad (2)$$

| | Solution A | Solution B |
|---|---|---|
| 4-amino-3-methyl-N-ethyl-N-(β-hydroxyethyl) aniline sulfate | None | 4.75 g |
| Potassium carbonate anhydrous | 37.5 g | 37.5 g |
| Potassium bromide | 1.3 g | 1.3 g |
| Trisodium nitriloacetate monohydrate | 2.5 g | 2.5 g |
| Water to make | 1 l | 1 l |

Adjust pH by using 10% potassiium hydroxide of 20% sulfric acid.

Concrete examples of the compound usable in the invention are shown below, but the compound of the invention is not limited thereto.

1

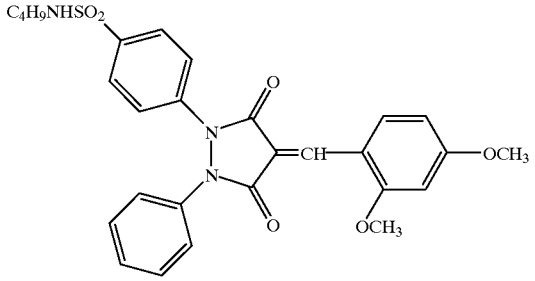

2

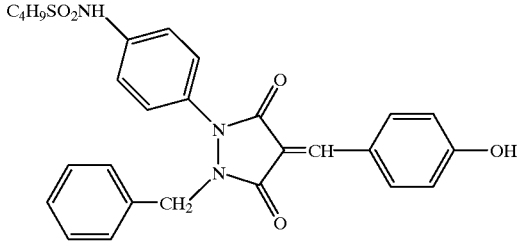

-continued
3
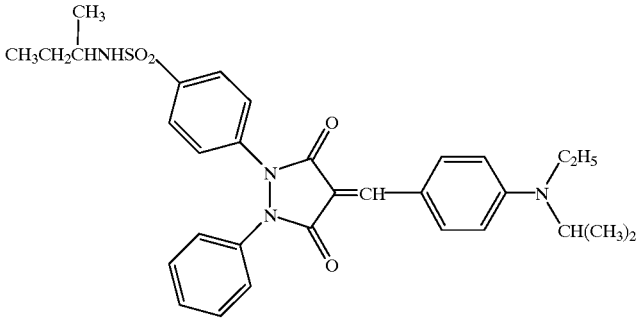
4
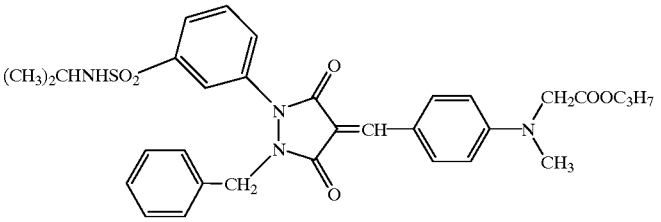
5
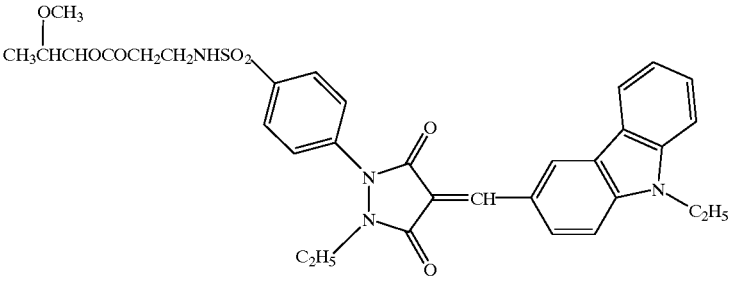
6
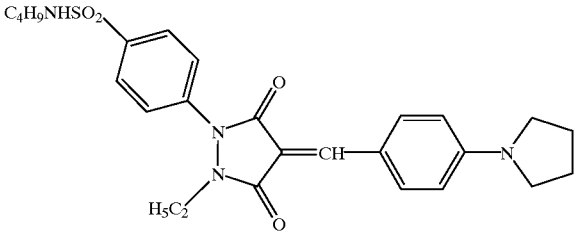
7
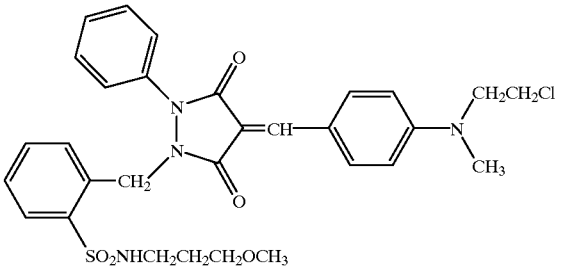

-continued
8
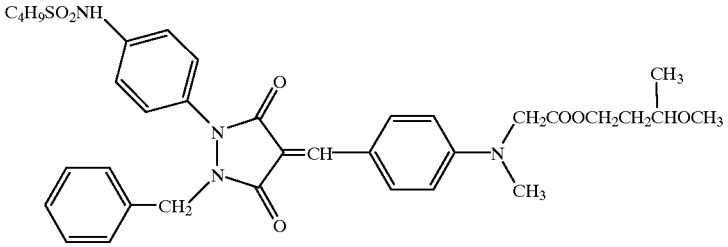
9
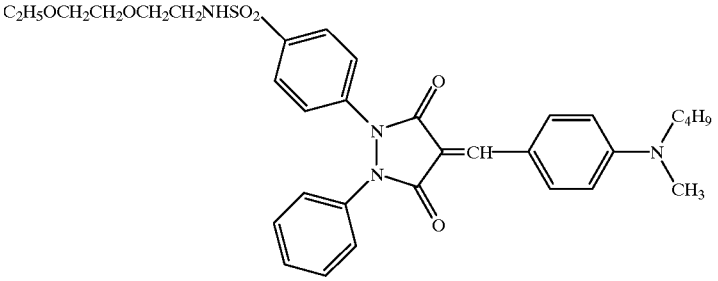
10
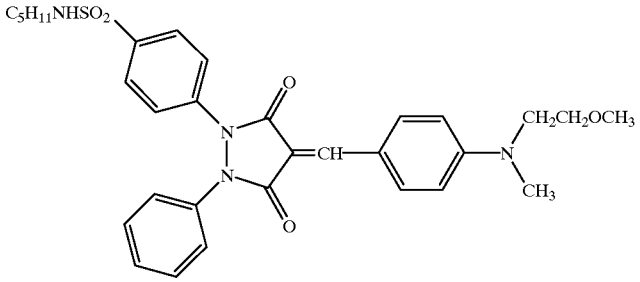
11
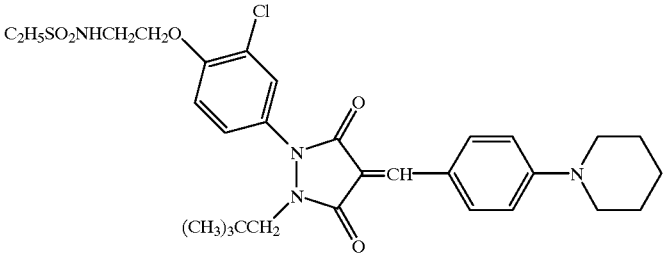
12
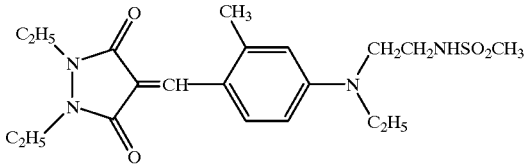
13
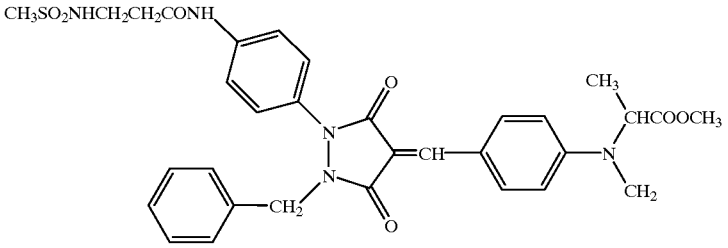

-continued
14
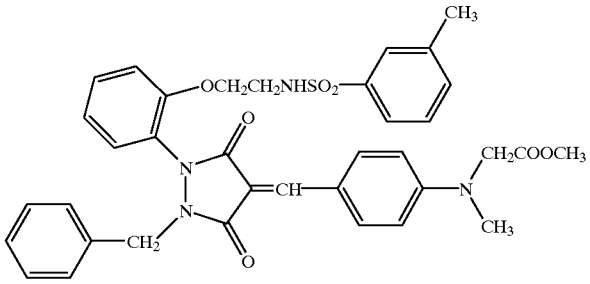
15
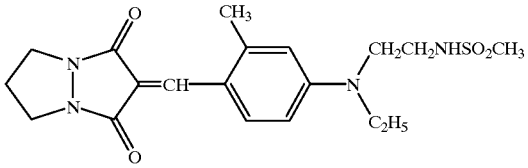
16
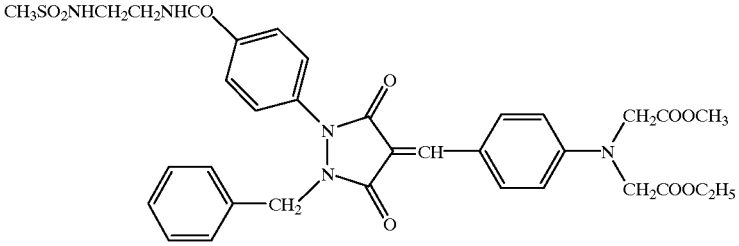
17
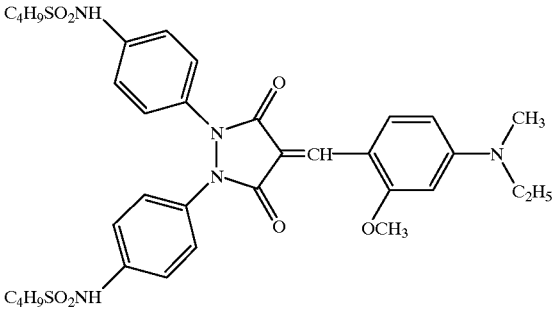
18
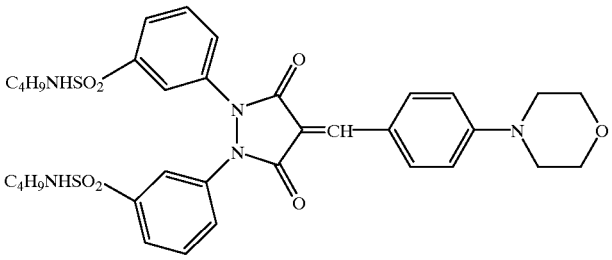
19
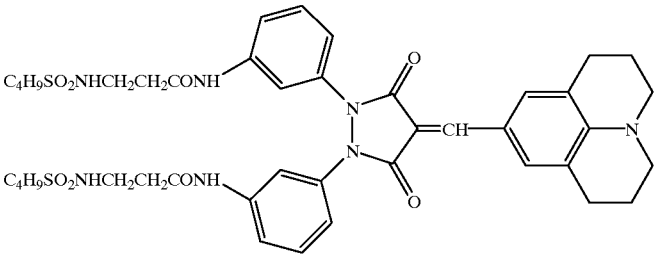

-continued
20
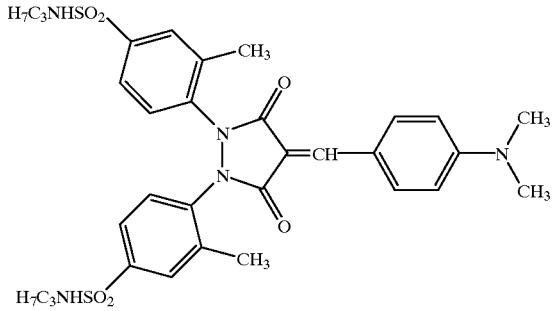
21
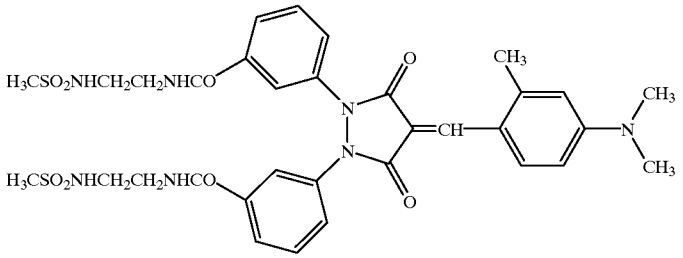
22
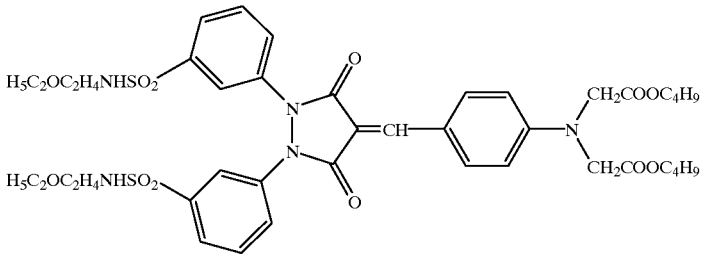
23
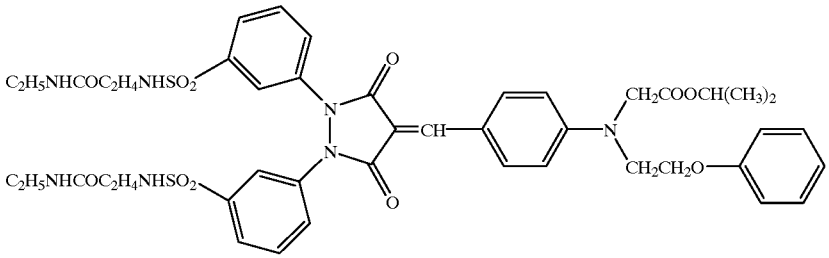
24
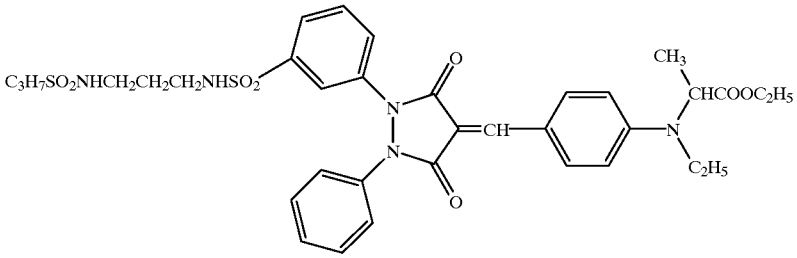

-continued
25
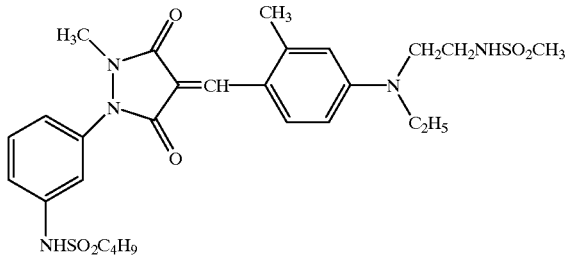
26
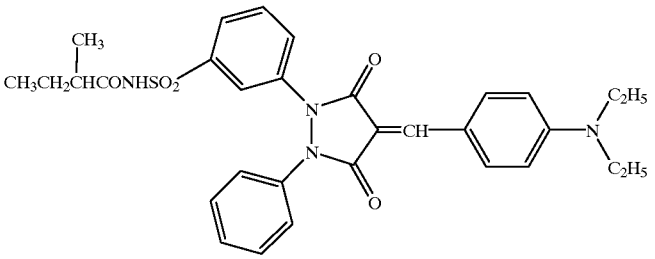
27
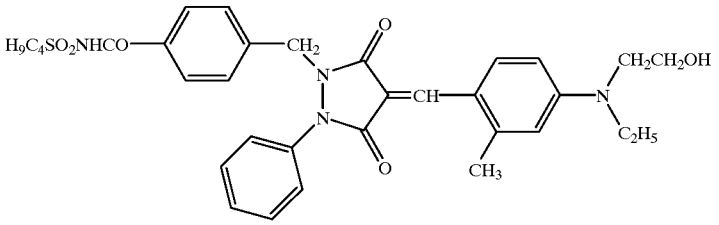
28
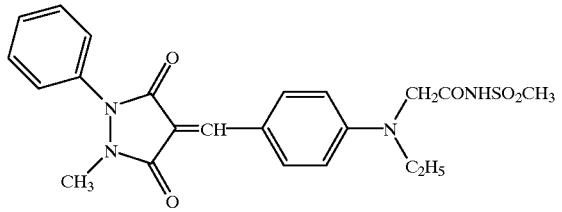
29
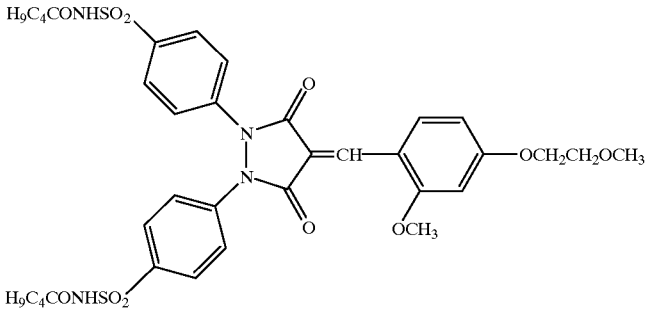

-continued
30
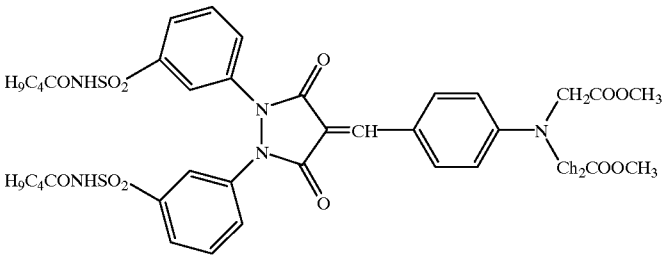
31
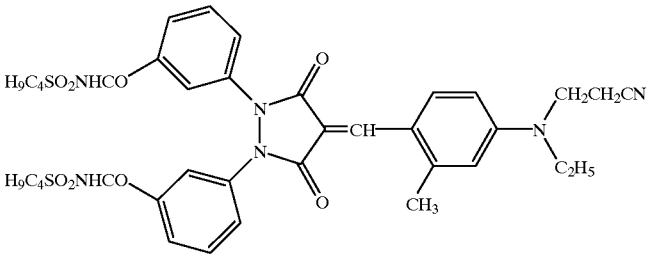
32
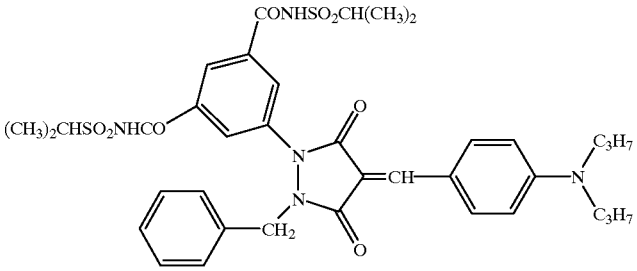
33
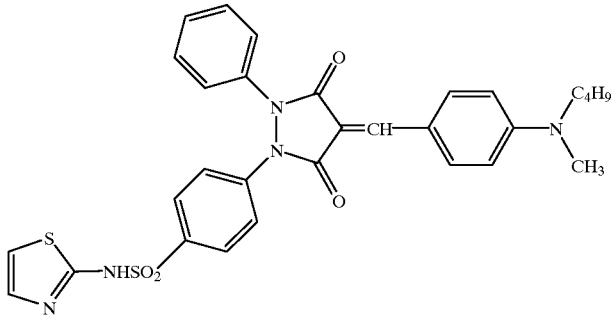
34
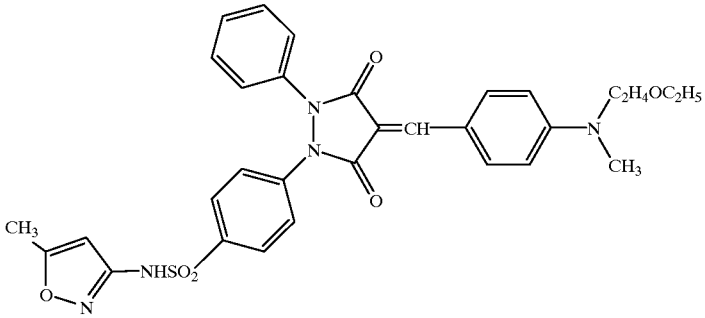

-continued
35
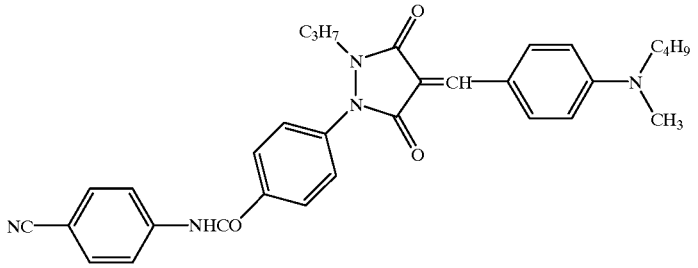
36
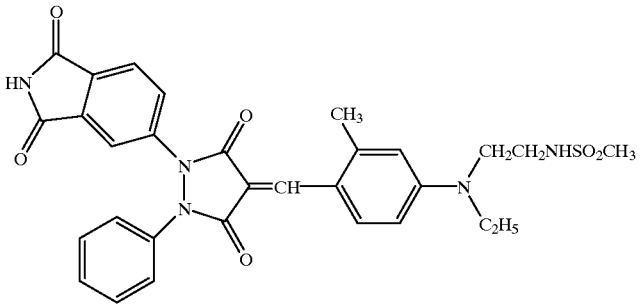
37
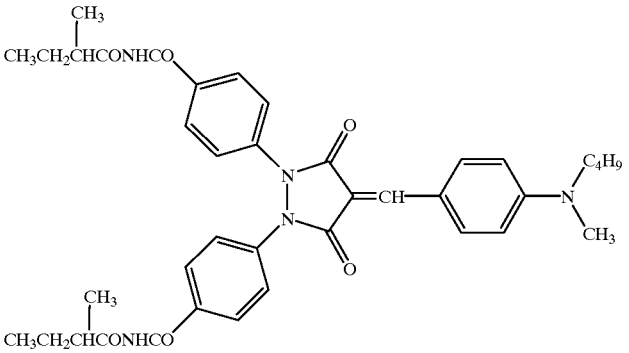
38
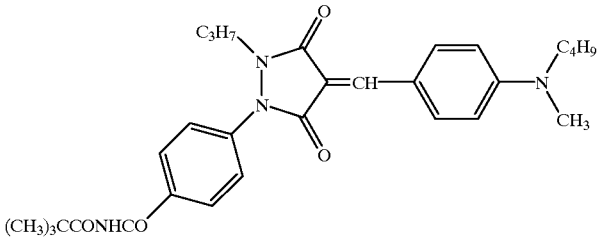
39
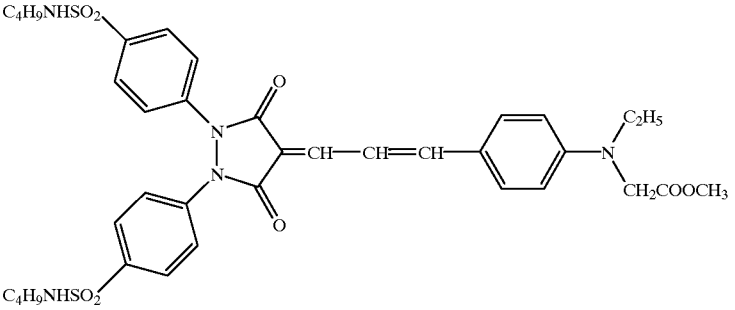

-continued
40
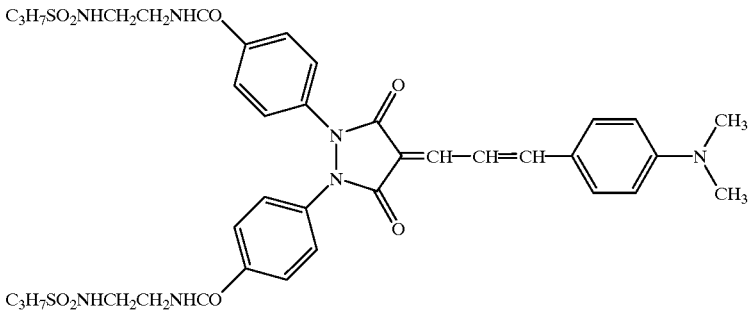
41
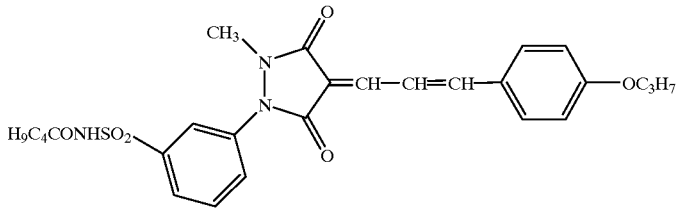
42
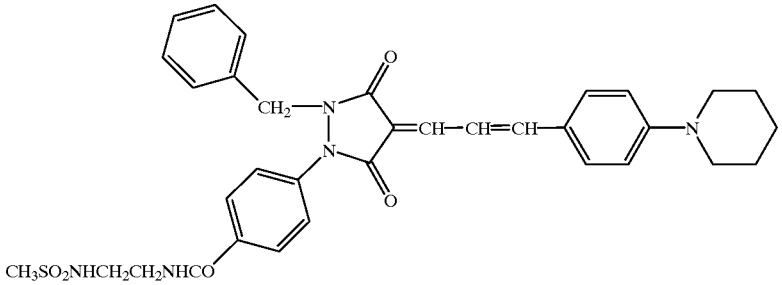
43
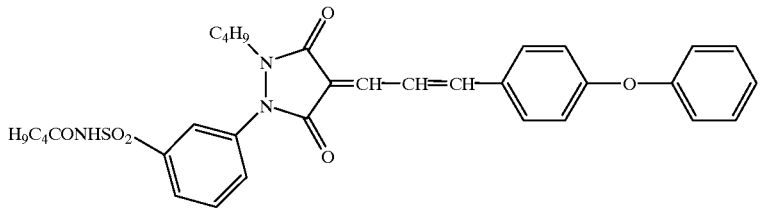
44
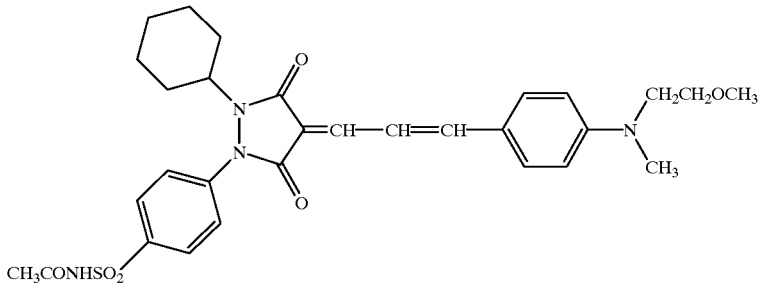

-continued
45
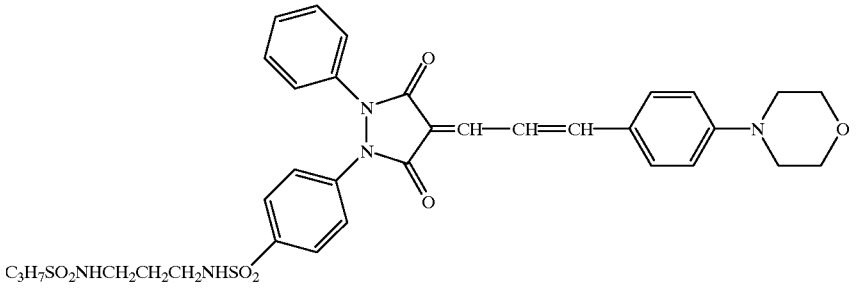
46
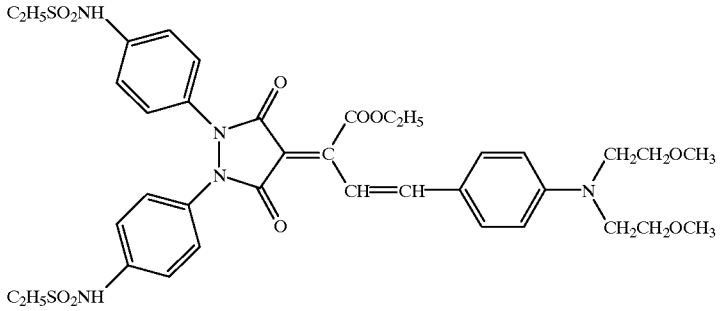
47
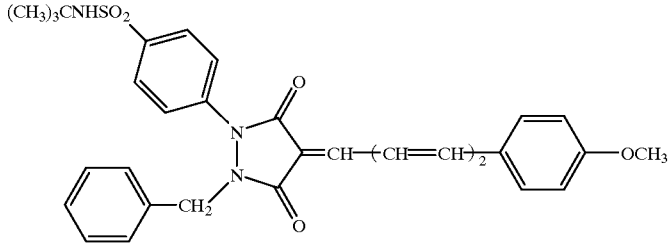
48
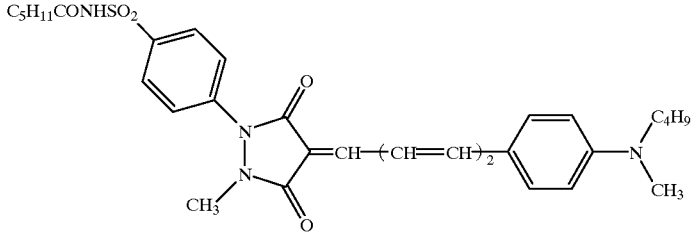
49
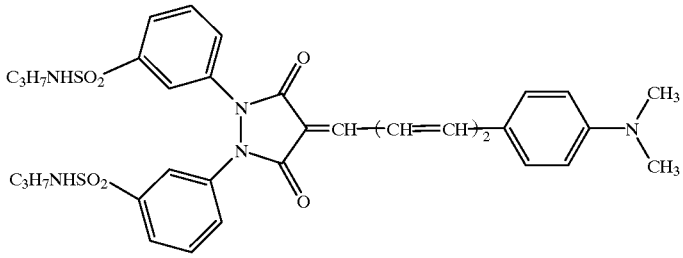

-continued

50

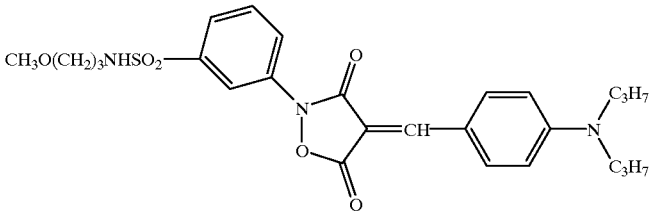

51

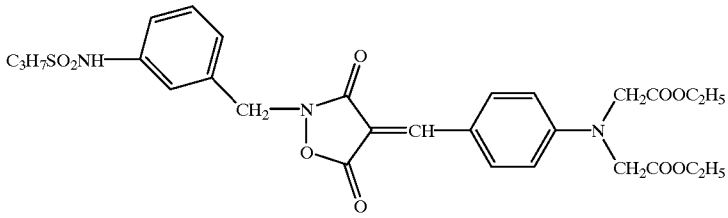

52

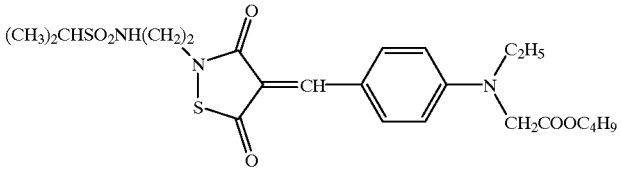

53

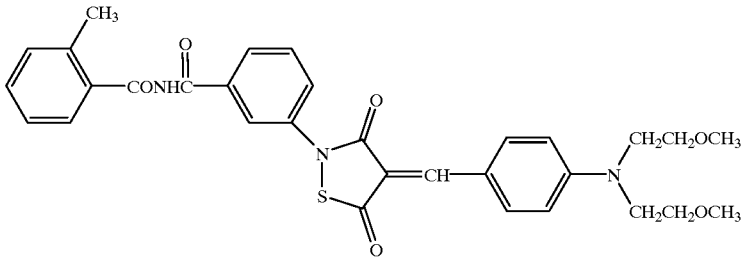

The compounds represented by Formula 1 or 2 can be synthesized by the reaction of 3,5-pyrazolidinedione with an aldehyde according to the method described in U.S. Pat. No. 4,853,366. 3,5-pyrazolidinedione can be synthesized by condensation of various hydrazine derivatives and malonic acid or an ester thereof.

A concrete synthesizing method is described below.

(Synthesis of exemplified compound 22)

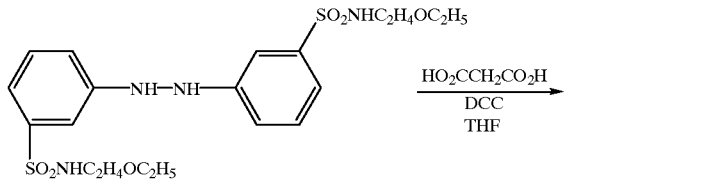

INTERMEDIATE 1

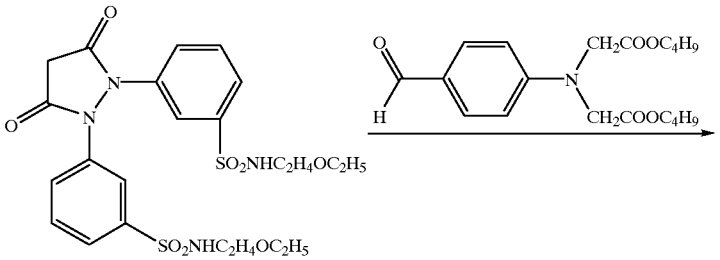

INTERMEDIATE 2

-continued

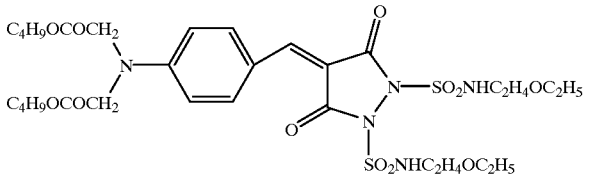

EXEMPLIFIED COMPOUND 22

Synthesis of Intermediate 2

In 150 ml of tetrahydrofuran, 15.0 g of Intermediate 1 was dissolved and 14.1 g of dicyclohexylcarbodiimide was added. Then 3.24 g of malonic acid was gradually added and reacted for 3 hours while chilling with ice. The reacted liquid was filtered to remove a solid matter. The solvent is remobed from thus obtained filtrate by evaporation under a reduced pressure. A precipitated solid substance was recrystallized using methanol, thus 15.5 g of pale yellow Intermediate 2 was obtained. The structure of the intermediate was confirmed by the magnetic nucleus resonance spectrum, mass spectrum and infrared absorption spectrum thereof.

Synthesis of Exemplified Compound 22

In 20 ml of n-propanol, 3.25 g of Intermediate 2 and 2.05 g of p-bis(butoxycarbonylmethyl)aminobenzaldehyde were dissolved and heated for 1 hour under reflux. The reacted liquid was chilled and a yellow powder of Exemplified Compound 22 precipitated was filtered. Yield of the compound was 5.1 g. The structure of the compound was confirmed by the magnetic nucleus resonance spectrum, mass spectrum and infrared absorption spectrum thereof. The maximum absorption in methanol was 460 nm.

The other exemplified compounds can be synthesized by a method similar to the above-mentioned method.

When the oil-soluble dye represented by Formula 1 or 2 is used as a filter dye or an antihalation dye, the dye is preferably used so that the optical density is within the range of 0.05 to 3.5. The dye is usually coated so that the coating amount is 1 to 800 mg per square meter of the light-sensitive material even though the effective amount of the dye may optionally be used. The dye may be added to a coating liquid at any time before coating.

The oil-soluble dye of the invention can be dispersed in an emulsion layer or another hydrophilic colloid layer such as an interlayer, a protective layer, an antihalation layer or a filter layer, by the following known method.

A solution prepared by dissolving the dye in a high-boiling solvent which is substantially insoluble in water and has a boiling point of not less than 160° C., is added and dispersed in a solution of hydrophilic colloid. As the high-boiling solvent, for example, an alkyl phthalate such as dibutyl phthalate and dioctyl phthalate, a phosphate such as diphenyl phosphate, triphenyl phosphate, tricresyl phosphate and dioctylbutyl phosphate, a citrate such as tributyl acetylcitrate, a benzoate such as octyl benzoate, an alkylamide such as diethyllaurylamide, a fatty acid ester such as dibutoxyethyl succinate and diethyl azelate and a trimesate such as tributyl trimesate are usable. Further an organic solvent having a boiling point of 30° C. to 60° C., for example a lower alkyl acetate such as methyl acetate and butyl acetate, sec-butyl alcohol, methyl iso-butyl ketone, β-ethoxyethyl acetate, methyl cellosolve acetate, and a water miscible solvent, for example, an alcohol such as methanol and ethanol can be used as an assistant solvent.

In the invention, known silver halide emulsions are usable. A preferable emulsion includes one comprising internal high-iodide type silver halide grains. The habit of the crystal may be cubic, tetradecahedral, octahedral and one in which (111) face and (100) face are optionally coexisted.

The silver halide grain may have a crystal structure in which the silver halide composition is different at the internal portion and the external portion of the crystal. In a preferable embodiment, the silver halide emulsion is a core/shell type monodisperse emulsion having a double layer structure composed of a core portion having a higher iodide content and a shell portion having a lower iodide content. The iodide content at the portion having the high iodide content is 20 to 40 mole-%, particularly preferably 20 to 30 mole-%.

Another type of the emulsion preferably usable in the invention is an emulsion comprising tabular grains having an average aspect ratio of not less than 1. An advantage of such the tabular grains is that a high spectral sensitization efficiency and improved graininess and sharpness of image can be obtained.

Generally, "tabular silver halide grain" means a grain which has two facing parallel major faces, and the ratio of the grain diameter to the grain thickness, hereinafter referred to an aspect ratio, is 1.3 or more. In the above, the "diameter" means average projection area diameter, hereinafter referred to a diameter, which is given in terms of the circle corresponding diameter of the projection area of the silver halide grain, i.e., the diameter of a circle having the area the same as the projection area of the silver halide grain, and the "thickness" is the average distance between the parallel major faces constituting the tabular silver halide grain.

It is preferred in the invention to use a silver halide emulsion which has been subjected to physical ripening, chemical ripening and optical sensitization.

In the invention, a sulfur sensitizer, selenium sensitizer and tellurium sensitizer are usable as a chemical sensitizer.

In the chemical sensitization, more higher sensitivity can be obtained by the use of gold sensitization in combination with another chemical sensitizer. As a suitable gold sensitizers, chloroauric acid, gold thiosulfate and gold thiocyanate are cited.

As the optical sensitizer, a polymethine dye may be cited which includes a cyanine dye, merocyanine dye, polynuclear merocyanine dye, holopolar cyanine dye, hemicyanine dye, styryl dye, hemioxonol dye, oxonol dye, merostyryl dye and streptocyanine dye.

Known photographic additives usable in the invention are described in the following Research Disclosure. The positions of the description are given below.

| [Item] | [RD308119, page] | [RD17643] | [RD18716] |
|---|---|---|---|
| Color contamination preventing agent | 1002 VII-I | 25 | 650 |
| Dye image | 1001 VII-J | 25 | |

-continued

| [Item] | [RD308119, page] | [RD17643] | [RD18716] |
|---|---|---|---|
| stabilizing agent | | | |
| Whitening agent | 998 V | 24 | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Anti-static agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 X VI | | |
| Developing agent (contained in a light-sensitive material) | 1011 XX-B | | |

In the invention, various couplers may be used. Concrete examples of the couplers are described in the following Research Disclosure. Portions of the description relating to the coupler in Research Disclosure are as follows.

| [Item] | [RD308119] | [RD17643] [RD18716] |
|---|---|---|
| Yellow coupler | 1001 VII-D | VII C - G |
| Magenta coupler | 1001 VII-D | VII C - G |
| Cyan coupler | 1001 VII-D | VII C - G |
| Colored coupler | 1002 VII-G | VII G |
| DIR coupler | 1001 VII-F | VII F |
| BAR coupler | 1002 VII-F | |
| Effective residue releasing coupler other than the above | 1001 VII-F | |
| Alkali-soluble coupler | 1001 VII-E | |

The additives to be used in the invention may be added by a dispersing method described in RD308119 XIV.

In the invention, a support described on page 28 of RD17643, pages 647–648 of RD18716 and in RD308119 XIX is usable.

In the light-sensitive material of the invention, an assistance layer such as a filter layer or interlayer described in RD308119 VII-K.

The light-sensitive material of the invention may have various layer arrangements such as a normal layer order, reverse layer order or unit layer constitution described in RD308119 VII-K.

The dye of the invention can be used for various porposes without any limitation such as anti-halation dye, anti-irradiation dye, and filter dye. The invention can be applied to various kinds of color light-sensitive material such as a color negative film for still photograph or movie, a color reversal film for slide or TV and a color positive film.

In the invention, a p-phenylenediamine derivative represented by the following Formula C is preferably used as the color developing agent to be contained in the color developer.

Formula C

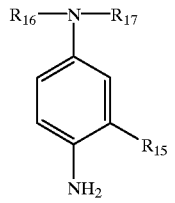

In the formula, $R_{15}$ is a hydrogen atom, a halogen atom or a atraight- or branched-chain alkyl group having 1 to 5 carbon atoms, which may have a substituent. $R_{16}$ and $R_{17}$ are each a hydrogen atom, an alkyl group or an aryl group, the alkyl group and aryl group each may have a substituent, and at least one of $R_{16}$ and $R_{17}$ is an akyl group substituted by a water solubilizing group such as carboxyl group, a sulfo group and an amino group, or a $-[(CH_2)_q-O]_p-R_{18}$ group, the alkyl group may have further a substituent. $R_{18}$ is a hydrogen atom or a straight- or branched-chain alkyl group having 1 to 5 carbon atoms and p and q are each an integer of 1 to 5.

Examples of the p-phenylenediamine derivative include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetoamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline and their salts such as a sulfate, hydrochloride, sulfite or p-toluenesulfonate thereof.

The color developing agent is usually used in a concentration of 0.1 g to 30 g, preferably 1 g to 15 g, per liter of developer.

EXAMPLES

Example 1

(1) A dispersion having the following composition was prepared by dispersing by ultrasonic wave.

| | |
|---|---|
| Dye of the invention 1 | 0.25 g |
| Tricresyl phosphate | 0.42 g |
| Ethyl acetate | 1.2 ml |
| Surfactant 1 | 1.4 ml |
| 10% aqueous solution of gelatin | 12.3 g |

A coating liquid having the following composition was prepared using the dispersion.

| | |
|---|---|
| The above-mentioned dispersion | 11.1 g |
| 10% aqueous solution of gelatin | 17.0 g |
| Purified water | 5.8 ml |
| 1% aqueous solution of Surfactant 2 | 1.4 ml |
| 1% aqueous solution of Hardener 1 | 15.4 ml |

-continued

Surfactant 1

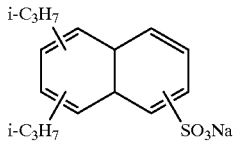

Surfactant 2

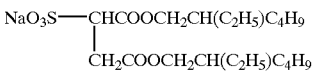

Hardener 1

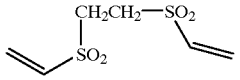

The coating liquid was coated on a triacetyl cellulose support so that the amount of gelatin was 1.2 g/m$^2$ and dried to prepare Sample 1-1. Samples 1-2 to 1-17 were prepared each using the compounds shown in Table 1 or Comparative dye 1, 2 or 3 in place of Compound 1.

The samples were immersed in the following developer for 1 minute at 25° C., washed for 20 seconds and dried.

Comparative dye 1

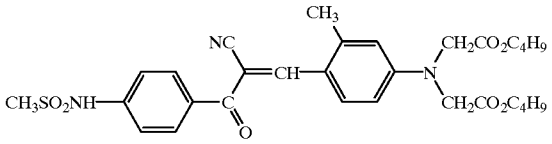

Comparative dye 2

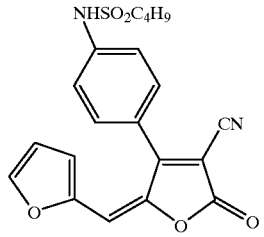

Comparative dye 3

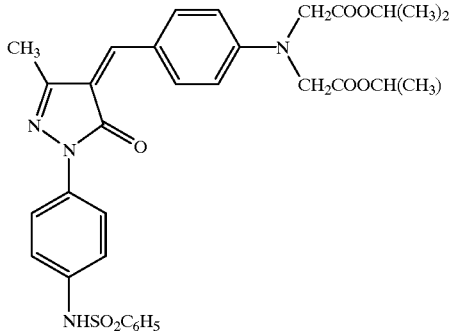

| (Composition of developer) | |
|---|---|
| Metol | 3.0 g |
| Sodium sulfite anhydrous | 45.0 g |
| Hydroquinone | 12.0 g |
| Sodium carbonate monohydrate | 80.0 g |
| Potassium bromide | 2.0 g |
| Water to make | 1 l |

<Decoloring ratio>

The visual light absorption spectrum of each sample was measured before and after immersion in the developer. The decoloring ratio was determined from the difference in the light absorbency at the maximum absorption wavelength. Results are shown in Table 1.

Decoloring ratio (%)=$(E_1-E_2)/E_1$33 100

IN the above equation, $E_1$ is the light absorbency before immersion in the developer and $E_2$ is that of after immersion in the developer.

<Diffusion-proof ability)

Samples 1-1 through 1-17 prepared in the same manner as in the above-mentioned were immersed for 10 minutes in a buffer solution of pH 7.0 and dried. The visual light absorption spectra of samples before and after immersion were measured, and the diffusion-proof ability of the dye was determined by the ratio of the light absorption. Results are listed in Table I together with the decoloration ratios.

Diffusion-proof ability=$E_3/E_4$

In the above equation, $E_3$ is the light absorbency after immersion in the buffer solution and $E_4$ is that of before immersion in the buffer solution.

TABLE 1

| Sample No. | Dye | Decoloring ratio (%) | Diffusion-proof ability |
|---|---|---|---|
| 1-1 (Invention) | Exemplified compound 1 | 96 | 0.99 |
| 1-2 (Invention) | Exemplified compound 4 | 95 | 0.96 |
| 1-3 (Invention) | Exemplified compound 6 | 98 | 0.95 |
| 1-4 (Invention) | Exemplified compound 9 | 95 | 0.97 |
| 1-5 (Invention) | Exemplified compound 11 | 96 | 0.98 |
| 1-6 (Invention) | Exemplified compound 15 | 97 | 0.95 |
| 1-7 (Invention) | Exemplified compound 22 | 96 | 0.95 |
| 1-8 (Invention) | Exemplified compound 26 | 98 | 0.99 |
| 1-9 (Invention) | Exemplified compound 30 | 96 | 0.95 |
| 1-10 (Invention) | Exemplified compound 33 | 95 | 0.95 |
| 1-11 (Invention) | Exemplified compound 40 | 97 | 0.98 |
| 1-12 (Invention) | Exemplified compound 44 | 94 | 0.99 |
| 1-13 (Invention) | Exemplified compound 45 | 96 | 0.96 |
| 1-14 (Invention) | Exemplified compound 49 | 97 | 0.99 |
| 1-15 (Comparative) | Comparative dye 1 | 81 | 0.79 |
| 1-16 (Comparative) | Comparative dye 2 | 51 | 0.50 |
| 1-17 (Comparative) | Comparative dye 3 | 83 | 0.68 |

It is clear from the results in Table 1 that the dyes of the invention show better decoloring property and diffusion-proof ability compared with the comparative dyes.

Example 2

Samples 1-1 through 1-17 were treated with the following treating solution A or B for 3 minute 15 seconds at 38° C. and the decoloration ratio of the samples were determined for observing the difference of the decoloring ratio caused by the presence of the developing agent. Results are shown in Table 2.

| Treating solution | A | B |
|---|---|---|
| 4-amino-3-methyl-N-ethyl-(β-hydroxyethyl)aniline sulfate | None | 4.75 g |
| Potassium carbonate anhydrous | 37.5 g | 37.5 g |
| Sodium bromide | 1.3 g | 1.3 g |
| Trisodium nitriloacetate monohydrate | 2.5 g | 2.5 g |
| Potassium hydroxide | 1.0 g | 1.0 g |

Water to make 1 l and the pH was adjusted to 10.05 by 10% aqueous solution of potassium hydroxide or 20% sulfric acid.

TABLE 2

| Sample No. | Decoloring ratio (treatment solution A) | Decoloring ratio (treatment solution B) |
|---|---|---|
| 1-1 (Inventive) | 12 | 91 |
| 1-2 (Inventive) | 11 | 93 |
| 1-3 (Inventive) | 13 | 92 |
| 1-4 (Inventive) | 14 | 91 |
| 1-5 (Inventive) | 12 | 94 |
| 1-6 (Inventive) | 12 | 93 |
| 1-7 (Inventive) | 15 | 92 |
| 1-8 (Inventive) | 10 | 95 |
| 1-9 (Inventive) | 14 | 94 |
| 1-10 (Inventive) | 13 | 92 |
| 1-11 (Inventive) | 14 | 94 |
| 1-12 (Inventive) | 12 | 93 |
| 1-13 (Inventive) | 15 | 91 |
| 1-14 (Inventive) | 13 | 92 |
| 1-15 (Comparative) | 15 | 20 |
| 1-16 (Comparative) | 19 | 23 |
| 1-17 (Comparative) | 18 | 21 |

As is shown in Table 2, in the samples 1-15 to 1-17 falling without the invention, increasing in the decoloring ratio by the color developing agent is slight. Contrary to that, in each of the Samples 1-1 to 1-14 using the dye of the invention, the decoloring ratio is considerably raised by the presence of the color developing agent.

Example 3

A multi-layer color light-sensitive material Sample 21 was prepared which was constituted by the layers having the following compositions provided on a subbed cellulose triacetate support.

In the followings, the amount of each component is given in terms of gram per $m^2$, other than one with a specific description. The amount of silver halide and colloidal silver is described in terms of silver, and the amount of sensitizing dye is described in terms of moles per mole of silver.

| Sample 21 | |
|---|---|
| 1st Layer: Anti-halation layer | |
| Black colloidal silver | 0.15 |
| UV absorbent (UV-S) | 0.20 |
| High-boiling solvent (Oil-1) | 0.16 |
| Gelatin | 1.64 |

-continued

| Sample 21 | |
|---|---|
| 2nd Layer: Interlayer | |
| Gelatin | 0.80 |
| 3rd Layer: Low-speed red-sensitive layer | |
| Iodobromide emulsion A | 0.44 |
| Iodobromide emulsion C | 0.11 |
| Sensitizing dye (SD-1) | $2.6 \times 10^{-5}$ |
| Sensitizing dye (SD-2) | $2.6 \times 10^{-5}$ |
| Sensitizing dye (SD-3) | $3.1 \times 10^{-4}$ |
| Sensitizing dye (SD-4) | $2.3 \times 10^{-5}$ |
| Sensitizing dye (SD-5) | $2.8 \times 10^{-4}$ |
| Cyan coupler (C-1) | 0.35 |
| Colored cyan coupler (CC-1) | 0.065 |
| High-boiling solvent (Oil-1) | 0.33 |
| Gelatin | 0.73 |
| 4th Layer: Medium-speed red-sensitive layer | |
| Iodobromide emulsion C | 0.39 |
| Sensitizing dye (SD-1) | $1.3 \times 10^{-4}$ |
| Sensitizing dye (SD-2) | $1.3 \times 10^{-4}$ |
| Sensitizing dye (SD-3) | $2.5 \times 10^{-4}$ |
| Sensitizing dye (SD-4) | $1.8 \times 10^{-5}$ |
| Cyan coupler (C-1) | 0.24 |
| Colored cyan coupler (CC-1) | 0.040 |
| DIR compound (DI-1) | 0.025 |
| High-boiling solvent (Oil-1) | 0.30 |
| Gelatin | 0.59 |
| 5th Layer: High-speed red-sensitive layer | |
| Iodobromide emulsion D | 0.91 |
| Sensitizing dye (SD-1) | $8.5 \times 10^{-5}$ |
| Sensitizing dye (SD-2) | $9.1 \times 10^{-5}$ |
| Sensitizing dye (SD-3) | $1.7 \times 10^{-4}$ |
| Sensitizing dye (SD-4) | $2.3 \times 10^{-5}$ |
| Sensitizing dye (SD-6) | $1.1 \times 10^{-5}$ |
| Cyan coupler (C-2) | 0.10 |
| Colored cyan coupler (CC-1) | 0.014 |
| DIR compound (DI-1) | $7.5 \times 10^{-3}$ |
| High-boiling solvent (Oil-1) | 0.12 |
| Gelatin | 0.53 |
| 6th Layer: Interlayer | |
| Gelatin | 1.14 |
| 7th Layer: Low-speed green-sensitive layer | |
| Iodobromide emulsion B | 0.32 |
| Iodobromide emulsion C | 0.74 |
| Sensitizing dye (SD-7) | $5.5 \times 10^{-4}$ |
| Sensitizing dye (SD-1) | $5.2 \times 10^{-5}$ |
| Sensitizing dye (SD-12) | $4.8 \times 10^{-5}$ |
| Magenta coupler (M-1) | 0.15 |
| Magenta coupler (M-2) | 0.37 |
| Colored magenta coupler (CM-1) | 0.20 |
| DIR compound (DI-2) | 0.020 |
| High-boiling solvent Oil-2) | 0.65 |
| Gelatin | 1.65 |
| 8th Layer: High-speed green-sensitive layer | |
| Iodobromide emulsion E | 0.79 |
| Sensitizing dye (SD-8) | $1.4 \times 10^{-4}$ |
| Sensitizing dye (SD-9) | $1.5 \times 10^{-4}$ |
| Sensitizing dye (SD-10) | $1.4 \times 10^{-4}$ |
| Sensitizing dye (SD-12) | $7.1 \times 10^{-5}$ |
| Magenta coupler (M-2) | 0.065 |
| Magenta coupler (M-3) | 0.025 |
| Colored magenta coupler (CM-2) | 0.025 |
| DIR compound (DI-3) | $7.0 \times 10^{-4}$ |
| High-boiling solvent (Oil-2) | 0.15 |
| Gelatin | 0.46 |
| 9th Layer: Yellow filter layer | |
| Yellow colloidal silver | 0.10 |
| Compound (FS-1) | 0.20 |
| High-boiling solvent (Oil-2) | 0.18 |
| Gelatin | 1.20 |

-continued

| Sample 21 | |
|---|---|
| 10th Layer: Low-speed blue-sensitive layer | |
| Iodobromide emulsion B | 0.27 |
| Iodobromide emulsion C | 0.32 |
| Sensitizing dye (SD-11) | $5.4 \times 10^{-4}$ |
| Sensitizing dye (SD-12) | $2.0 \times 10^{-4}$ |
| Sensitizing dye (SD-6) | $6.5 \times 10^{-5}$ |
| Yellow coupler (Y-1) | 0.62 |
| Yellow coupler (Y-2) | 0.31 |
| DIR compound (DI-1) | $3.0 \times 10^{-3}$ |
| DIR compound (DI-3) | $6.0 \times 10^{-4}$ |
| High-boiling solvent (Oil-2) | 0.20 |
| Gelatin | 1.27 |
| 11th Layer: High-speed blue-sensitive layer | |
| Iodobromide emulsion E | 0.66 |
| Sensitizing dye (SD-11) | $2.8 \times 10^{-4}$ |
| Sensitizing dye (SD-12) | $1.1 \times 10^{-4}$ |
| Sensitizing dye (SD-6) | $1.1 \times 10^{-5}$ |
| Yellow coupler (Y-1) | 0.10 |
| DIR compound (DI-3) | $1.0 \times 10^{-3}$ |
| High-boiling solvent (Oil-2) | 0.04 |
| Gelatin | 0.57 |
| 12th Layer: 1st protective layer | |
| Iodobromide emulsion (Average grain diameter: 0.04 μm, iodide content: 4.0 mol-%) | 0.30 |
| UV absorbent (UV-S) | 0.07 |
| UV absorbent (UV-A) | 0.02 |
| UV absorbent (UV-B) | 0.09 |
| Compound (FS-1) | 0.25 |
| High-boiling solvent (Oil-1) | 0.07 |
| High-boiling solvent (Oil-3) | 0.07 |
| Gelatin | 1.04 |

-continued

| Sample 21 | |
|---|---|
| 13th Layer: 2nd protective layer | |
| Alkali-soluble matting agent (average diameter: 2 μm) | 0.15 |
| Polymethyl methacrylate (average diameter: 3 μm) | 0.04 |
| Lubricant (WAX-1) | 0.04 |
| Gelatin | 0.55 |

Coating aid SU-1, Dispersion aid SU-2, a viscosity controlling agent, Hardeners H-1 and H-2, Stabilizing agent ST-1, Anti-foggant AF-1, two kinds of AF-2 each having a molecular weight of 10,000 and 20,000 and antiseptic AB-1 were added other than the foregoing additives.

The emulsions used in the above sample were as follows. The average diameter is described in the diameter of a sphere having the same volume as the silver halide grain. The emulsions were subjected to optimum gold-sulfur sensitization.

| Emulsion name | AgI content (Mole-%) | Average diameter (μm) | Crystal habit | Diameter/thickness ratio |
|---|---|---|---|---|
| Emulsion A | 2.0 | 0.27 | Regular tetradecahedral | 1 |
| Emulsion B | 2.0 | 0.30 | Regular tetradecahedral | 1 |
| Emulsion C | 8.0 | 0.38 | Twined octahedral | 1.5 |
| Emulsion D | 8.0 | 0.55 | Twined octahedral | 1.5 |
| Emulsion E | 8.0 | 0.65 | Twined octahedral | 1.5 |

C-1

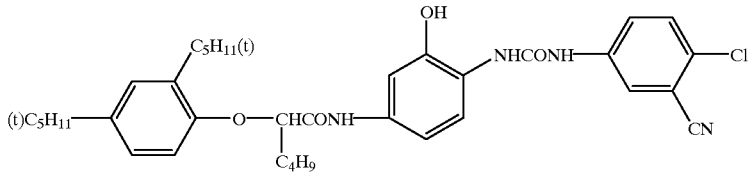

C-2

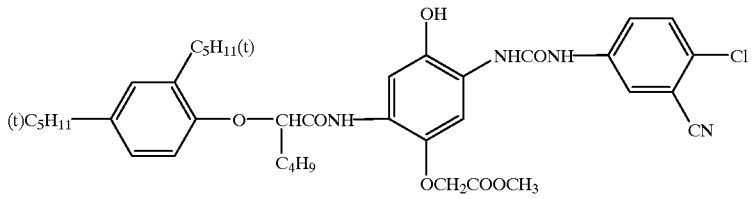

M-1

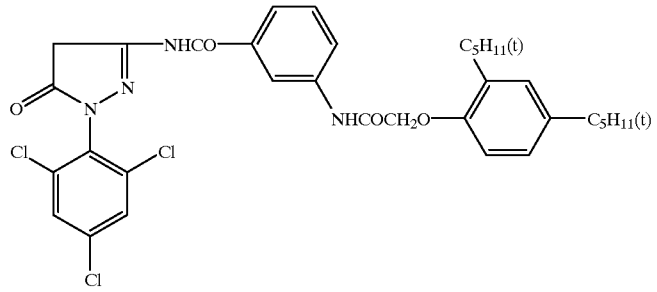

-continued
M-2
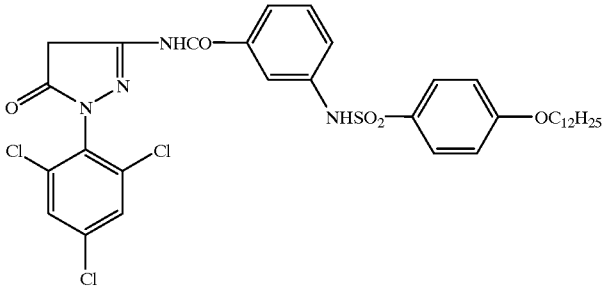
M-3
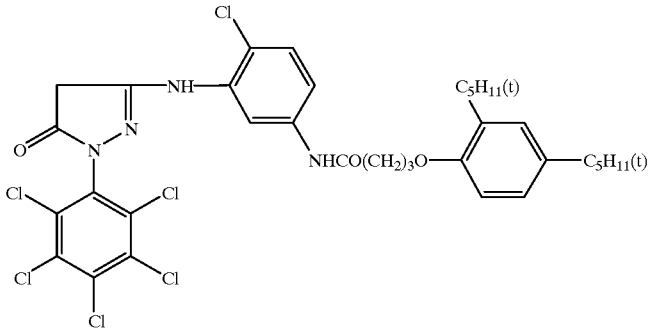
Y-1
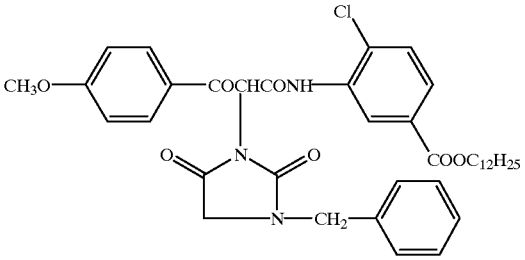
Y-2
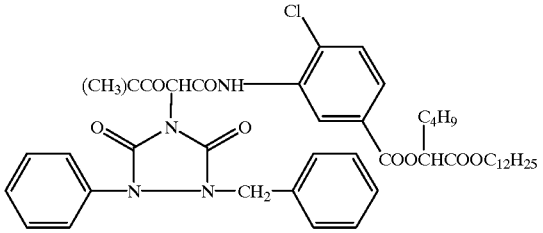
CC-1
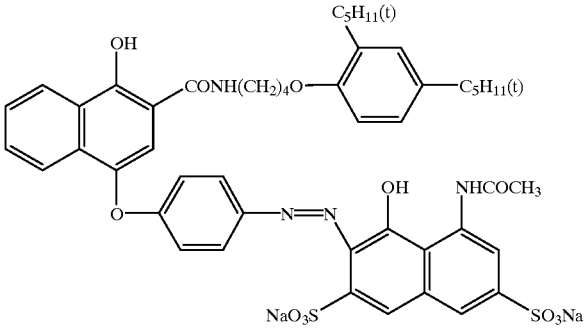

-continued
CM-1
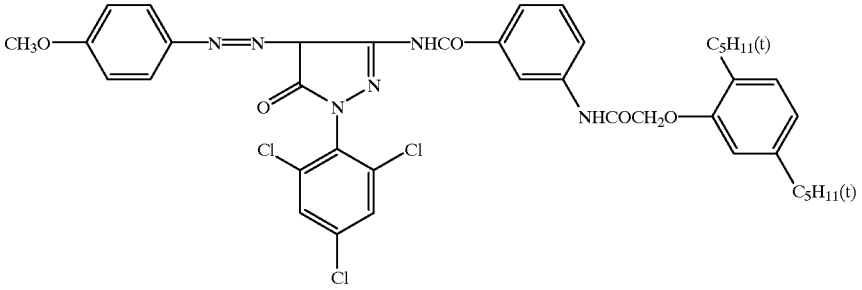
CM-2
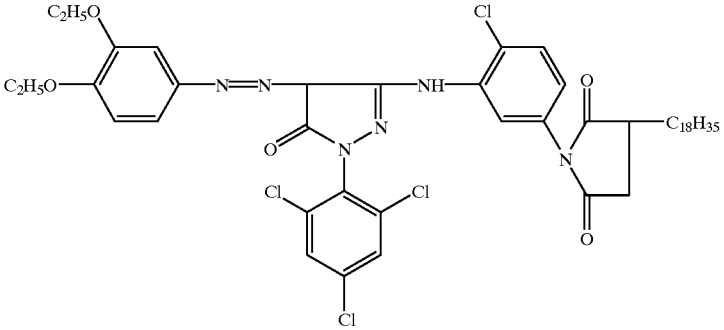
Oil-1
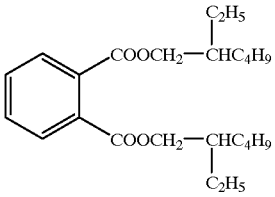
Oil-2
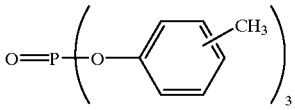
Oil-3
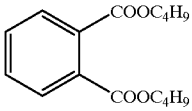
Oil-4
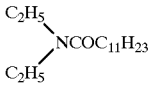
Oil-5
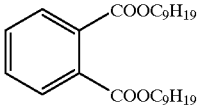
Oil-6
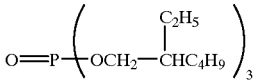
Oil-7
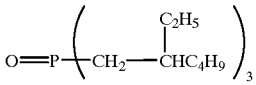

-continued
Oil-8
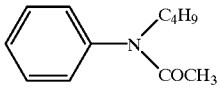
Oil-9
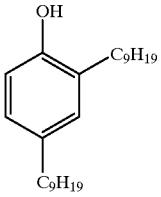
Oil-10
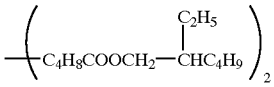
DI-1
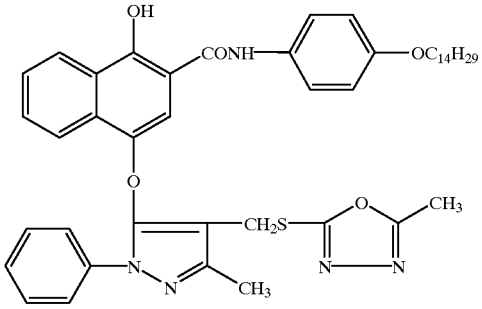
DI-2
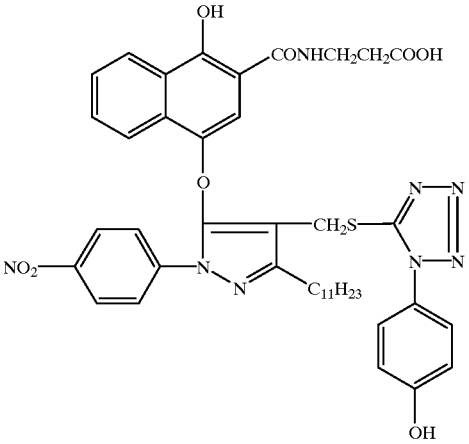
DI-3
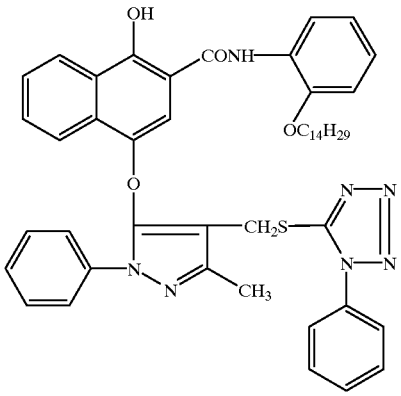

-continued
SU-1
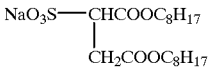
SU-2
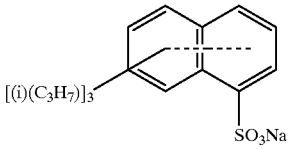
FS-1
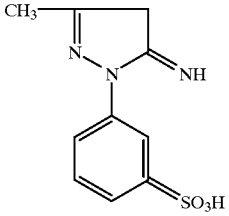
H-1
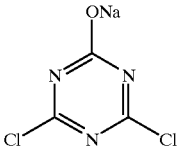
H-2
$(CH_2{=}CHSO_2CH_2)_2O$
WAX-1
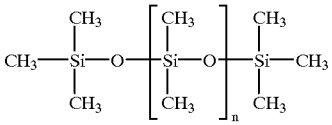
MW:3000
UV-S
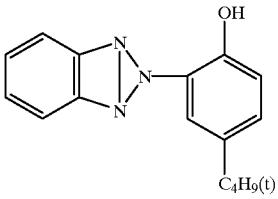
UV-A
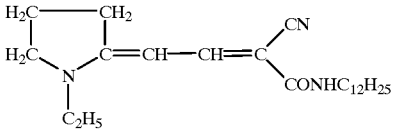
UV-B
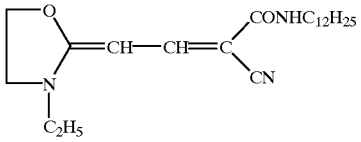
ST-1
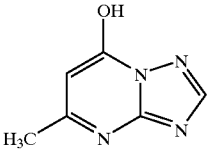

-continued
AF-1
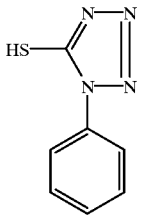
SD-1
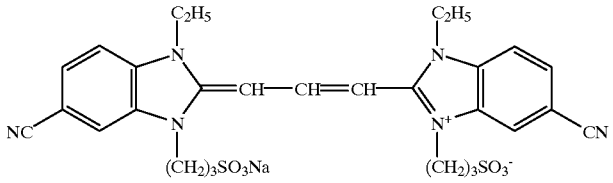
SD-2
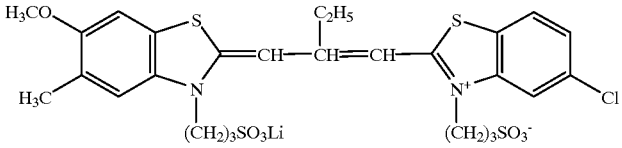
SD-3
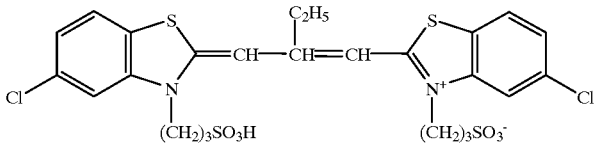
SD-4
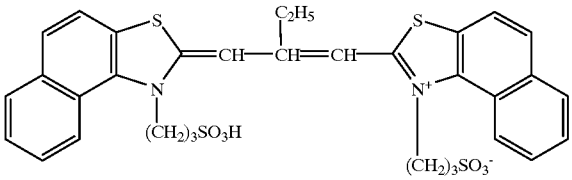
SD-5
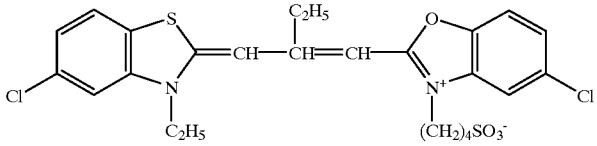
SD-6
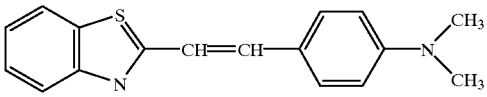
SD-7
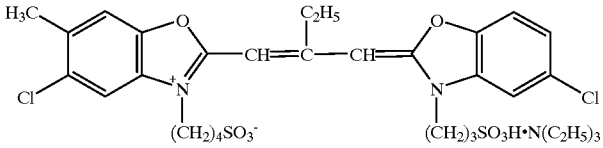

-continued

SD-8

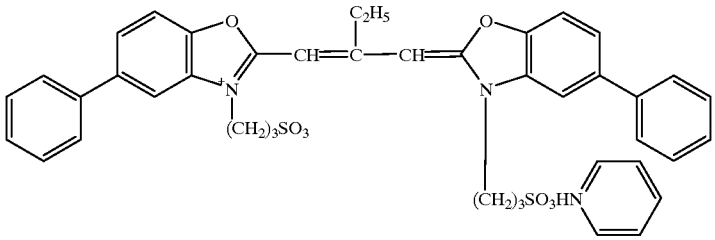

SD-9

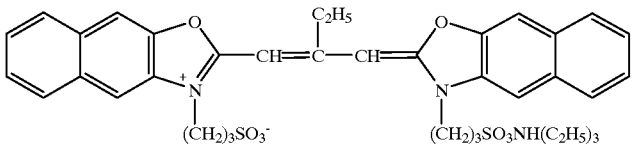

SD-10

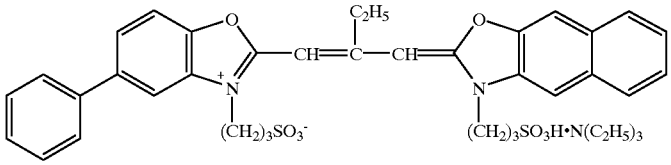

SD-11

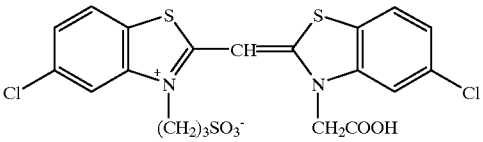

SD-12

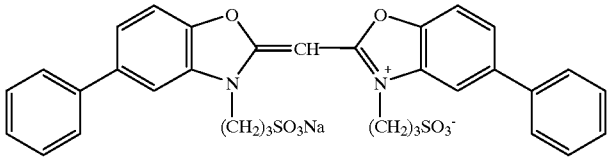

AF-2

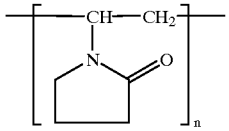

n: polymerization degree

AB-1

(component A) (component B) (component C)

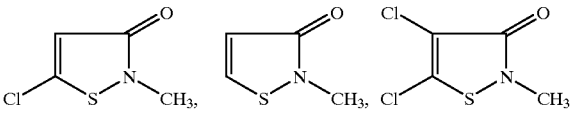

Composition A:B:C = 50:46:4 (in molar ratio)

Samples 22 through 45 were prepared in the same manner as in Sample 21 except that dispersions of the following compounds were each added in the 9th layer (yellow filter layer) in place of the yellow colloidal silver so that the amount of the dye was 200 mg per $m^2$.

Method for dispersion

In 3.0 g of a high-boiling solvent and 15 g of ethyl acetate, 1.5 g of the dye was dissolved. The soution is added to a solution composed of 100 g of purified water, 10 g of gelatin and 0.3 g of sodium triios-propylnaphthalate, and dispersed for 1 hour by a high-speed impeller dispersing machine (Power Homogenizer PM-1 manufactured by Nihon Seiki Seisakysyo Co., Ltd.) with a rotating speed of 2000 rpm. The high-boilung solvent was changed as shown in Table 3 in each of the samples.

Samples 21 through 45 were exposed to light for sensitometry and processed by the following processes for determining the fog and sensitivity of the green-sensitive layer.

The fog was determined by increasing of green-light density of the unexposed portion of the sample processed by the following processing compared with the green light-density of the sample processed by the bleaching and the steps after the bleaching without the developing step.

The sensitivity is determined by the reciprocal of the exposure amount necessary to form a density of fog +0.3 and given by a relative value based on that of Sample 21 which is set as 100.

Further, Samples 21 through 45 were stood for 5 days at 40° C. under a relative humidity of 90%, exposed to white light for sensitometry and processed by the following processing steps for measuring the sensitivity of the blue-sensitive layer and evaluating the storage ability of the samples. The sensitivity is determined by the reciprocal of the exposure amount necessary to form a density of fog +0.3 and given by a relative value based on that of Sample 21 which is set as 100. Results are listed in Table 3 together with.

| Processing steps (38° C.) | |
|---|---|
| Color development | 3 minutes 15 seconds |
| Bleaching | 6 minutes 30 seconds |
| Washing | 3 minutes 15 seconds |
| Fixing | 6 minutes 30 seconds |
| Washing | 3 minutes 15 seconds |
| Stabilizing | 1 minute 30 seconds |
| Drying | |

The processing solutions used in each step are as follows:

| <Color developer> | |
|---|---|
| 4-amino-3-methyl-N-ethyl-N-(β-hydroxyethyl)aniline sulfate | 4.75 g |
| Sodium sulfite anhydrous | 4.25 g |
| Hydroxylamine ½ sulfate | 2.0 g |
| Potassium carbonate anhydrous | 37.5 g |
| Sodium bromide | 1.3 g |
| Potassium iodide | 1.0 mg |
| Trisodium nitriloacetate monohydrate | 2.5 g |
| Potassium hydroxide | 1.0 g |
| Water to make | 1 l |
| <Bleaching solution> | |
| Ferric ammonium thylenediamine-tetraacetate | 100 g |
| Diammonium ethylenediamine-tetraacetate | 10.0 g |
| Ammonium bromide | 150.0 g |
| Glacial acetic acid | 10 ml |
| Water to make | 1 l |
| Adjust pH to 6.0 using ammonia water | |
| <Fixer> | |
| Ammonium thiosulfate (37% aqueous solution) | 175.0 g |
| Sodium sulfite anhydrous | 8.5 g |
| Sodium metabisulfite | 2.3 g |
| Water to make | 1 l |
| Adjust pH to 6.0 using acetic acid. | |
| <Stabilizer> | |
| Formalin (37% aqueous solution) | 1.5 ml |
| Koniducks (Manufactured by Konica Corp.) | 7.5 ml |
| Water to make | 1 l |

Results are shown in Table 3.

TABLE 3

| Sample No. | Dye | High-boiling solvent | Sensitivity | Fog | Storage ability | Note |
|---|---|---|---|---|---|---|
| 21 | — | — | 100 | 0.21 | 91 | Comparative |
| 22 | Comparative dye 2 | Oil-2 | 91 | 0.15 | 52 | Comparative |
| 23 | Comparative dye 3 | Oil-2 | 95 | 0.13 | 71 | Comparative |
| 24 | 22 | Oil-2 | 105 | 0.09 | 102 | Inventive |
| 25 | 30 | Oil-2 | 104 | 0.11 | 101 | Inventive |
| 26 | 37 | Oil-2 | 106 | 0.10 | 103 | Inventive |
| 27 | 22 | Oil-3 | 105 | 0.08 | 101 | Inventive |
| 28 | 30 | Oil-3 | 108 | 0.08 | 104 | Inventive |
| 29 | 37 | Oil-3 | 106 | 0.07 | 102 | Inventive |
| 30 | 22 | Oil-4 | 106 | 0.10 | 101 | Inventive |
| 31 | 30 | Oil-4 | 107 | 0.11 | 103 | Inventive |
| 32 | 37 | Oil-4 | 104 | 0.08 | 100 | Inventive |
| 33 | 22 | Oil-5 | 108 | 0.08 | 103 | Inventive |
| 34 | 30 | Oil-5 | 105 | 0.09 | 100 | Inventive |
| 35 | 37 | Oil-5 | 104 | 0.11 | 100 | Inventive |
| 36 | 22 | Oil-6 | 106 | 0.10 | 101 | Inventive |
| 37 | 22 | Oil-7 | 105 | 0.08 | 101 | Inventive |
| 38 | 22 | Oil-8 | 108 | 0.08 | 104 | Inventive |
| 39 | 22 | Oil-9 | 106 | 0.07 | 102 | Inventive |
| 40 | 22 | Oil-10 | 106 | 0.10 | 101 | Inventive |
| 41 | 30 | Oil-6 | 103 | 0.10 | 100 | Inventive |
| 42 | 30 | Oil-7 | 105 | 0.09 | 101 | Inventive |
| 43 | 30 | Oil-8 | 105 | 0.09 | 102 | Inventive |
| 44 | 30 | Oil-9 | 106 | 0.07 | 103 | Inventive |
| 45 | 30 | Oil-10 | 106 | 0.08 | 102 | Inventive |

As is shown in Table 2, lowering in the sensitivity of the green-sensitive emulsion layer is larger and lowering in the sensitivity of the blue-sensitive emulsion layer after storage is considerably larger in Samples 22 and 23 containing dyes falling without scope of the invention compared with those in Sample 21 in which yellow colloidal silver is used. Contrary to that, Samples 24 through 45 in which the dispersion of the oil-soluble dye in the high-boiling solvent each have a low fog and an excellent storage ability.

What is claimed is:

1. A silver halide photographic light-sensitive material comprising a support having thereon one or more photographic constituent layers, at least one of said layers containing a compound represented by the following Formula 2 in a form of a high-boiling solvent solution:

Formula 2

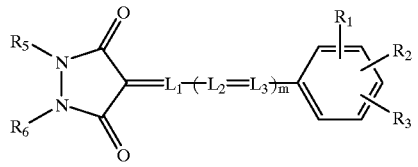

wherein $R_1$, $R_2$ and $R_3$ are each independently a hydrogen atom, or a first substituent, two of $R_1$, $R_2$ and $R_3$ may form a ring, $L_1$, $L_2$ and $L_3$ are each a methine group, m is 0, 1, or 2, $R_5$ and $R_6$ are each independently an alkyl group, a cycloalkyl group, an aryl group, or a heterocyclic group, when both of $R_5$ and $R_6$ are each an aryl group, at least one of them has a second substituent selected from the group consisting of $C_4H_9NHSO_2$—, $CH_3CH_2CH(CH_3)NHSO_2$—, $C_2H_5OCH_2CH_2OCH_2CH_2NHSO_2$—, $C_5H_{11}NHSO_2$—, $C_4H_9SO_2NH$—, $C_4H_9SO_2NHCH_2CH_2CONH$—, $C_3H_7NHSO_2$—, $CH_3SO_2NHCH_2CH_2NHCO$—, $C_2H_5OC_2H_4NHSO_2$—, $C_2H_5NHCOC_2H_4NHSO_2$—, $C_3H_7SO_2NHCH_2CH_2CH_2NHSO_2$—, $CH_3CH_2CH(CH_3)CONHSO_2$—, $C_4H_9SO_2NHCO$—, $C_4H_9CONHSO_2$—

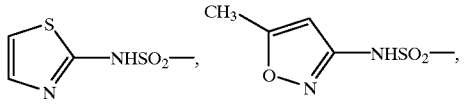

$CH_3CH_2C(CH_3)HCONHCO$—, $C_3H_7SO_2NHCH_2CH_2NHCO$—, $C_3H_7SO_2NHCH_2CH_2CH_2NHSO_2$—, and $C_2H_5SO_2NH$—, provided that the compound has, in the molecule thereof, at least one group selected from the group consisting of sulfonamido, carbamoyl, sulfamoyl, —$SO_2NHCOR_4$, —$CONHSO_2R_4$, and —$CONHCOR_4$, in which $R_4$ is an alkyl group, a cycloalkyl group, an aryl group, a heterocyclic group, an alkoxy group or an amino group.

2. The silver halide light-sensitive material of claim 1 wherein said compound is present in a coating amount of 1 to 800 mg/$m^2$ of said light-sensitive material.

3. A silver halide photographic light-sensitive material comprising a support having thereon one or more photographic constituent layers, in which at least one of said layers contains an oil-soluble dye represented by the following Formula 2;

Formula 2

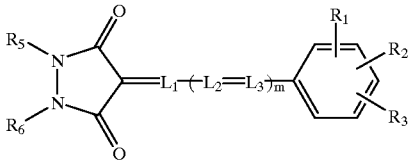

wherein $R_1$, $R_2$ and $R_3$ are each independently a hydrogen atom or a first substituent, two of $R_1$, $R_2$ and $R_3$ may form a ring, $L_1$, $L_2$ and $L_3$ are each independently a methine group, m is 2, 1 or 2, $R_5$ , and $R_6$ are each independently an alkyl group, a cycloalkyl group, an aryl group, or a heterocyclic group, when both of $R_5$ and $R_6$ are each an aryl group, at least one of them has a second substituent, provided that the dye has, in the molecule thereof, at least one group selected from the group consisting of a carbamoyl group, sulfamoyl group, sulfonamido group, an —$SO_2NHCOR_4$ group, a —$CONHSO_2R_4$ group and a —$CONHCOR_4$ group, in which $R_4$ is an alkyl group, a cycloalkyl group, an aryl group, a heterocyclic group, an alkoxy group or an amino group.

4. The silver halide photographic light-sensitive material of claim 3, wherein said second substituent is selected from the group consisting of $C_4H_9NHSO_2$—, $CH_3CH_2CH(CH_3)NHSO_2$—, $C_2H_5OCH_2CH_2OCH_2CH_2NHSO_2$—, $C_5H_{11}NHSO_2$—, $C_4H_9SO_2NH$—, $C_4H_9SO_2NHCH_2CH_2CONH$—, $C_3H_2NHSO_2$—, $CH_3SO_2NHCH_2CH_2NHCO$—, $C_2H_5OC_2H_4NHSO_2$—, $C_2H_5NHCOC_2H_4NHSO_2$—, $C_3H_7SO_2NHCH_2CH_2CH_2NHSO_2$—, $CH_3CH_2CH(CH_3)CONHSO_2$—, $C_4H_9SO_2NHCO$—, $C_4H_9CONHSO_2$—

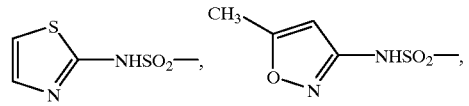

$CH_3CH_2C(CH_3)HCONHCO$—, $C_3H_7SO_2NHCH_2CH_2NHCO$—, $C_3H_7SO_2NHCH_2CH_2CH_2NHSO_2$—, and $C_2H_5SO_2NH$—.

5. A silver halide photographic light-sensitive material comprising a support having thereon one or more photographic constituent layers, in which at least one of said layers contains a compound represented by Formula 2;

Formula 2

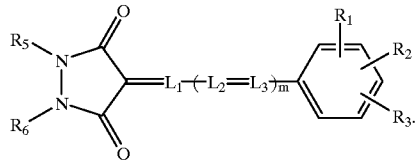

wherein $R_1$, $R_2$ and $R_3$ are each independently a hydrogen atom or a first substituent, two of $R_1$, $R_2$ and $R_3$ may form a ring, $L_1$, $L_2$ and $L_3$ are each a methine group, m is 0, 1 or 2, and $R_5$ and $R_6$ are each independently an aryl group, and at least one of the aryl groups has a second substituent selected from the group consisting of a carbamoyl group, and a sulfonyl group, provided that the compound has, in the molecule thereof, at least one group selected from the group consisting of a carbamoyl group, a sulfamoyl group, a sulfonamido group, an —$SO_2NHCOR_4$ group, —$CONHSO_2R_4$ group and a —$CONHCOR_4$ group, in which $R_4$ is an alkyl group, a cycloalkyl group, an aryl group, a heterocyclic group, an alkoxy group or an amino group.

6. The silver halide photographic light-sensitive material according to claim 5 wherein said compound is

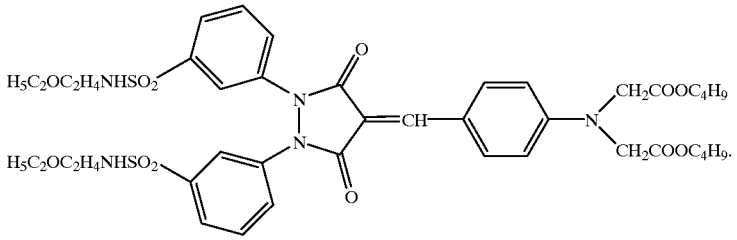

* * * * *